US006684835B2

(12) United States Patent
Komazawa et al.

(10) Patent No.: US 6,684,835 B2
(45) Date of Patent: Feb. 3, 2004

(54) VALVE TIMING CONTROL DEVICE

(75) Inventors: Osamu Komazawa, Chita (JP); Hiroshi Kubo, Anjo (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/309,901

(22) Filed: Dec. 5, 2002

(65) Prior Publication Data

US 2003/0121486 A1 Jul. 3, 2003

(30) Foreign Application Priority Data

Dec. 5, 2001 (JP) ..... 2001-371912

(51) Int. Cl.[7] ..... F01L 1/34

(52) U.S. Cl. ..... 123/90.17; 123/90.12; 123/90.15; 464/1; 464/2; 464/160

(58) Field of Search ..... 123/90.17, 90.12, 123/90.15–90.18, 90.31; 464/1, 2, 160

(56) References Cited

U.S. PATENT DOCUMENTS 6,408,807 B1 * 6/2002 Komazawa et al. ..... 123/90.17
6,443,113 B1 * 9/2002 Kanada et al. ..... 123/90.17
6,532,922 B2 * 3/2003 Komazawa ..... 123/90.17

FOREIGN PATENT DOCUMENTS

JP 2001-41012 A 2/2001
JP 2001-50063 A 2/2001

* cited by examiner

*Primary Examiner*—Thomas Denion
*Assistant Examiner*—Kyle Riddle
(74) *Attorney, Agent, or Firm*—Burns, Doane, Swecker & Mathis, LLP

(57) ABSTRACT

A valve timing control device is provided, which has an advantageous point of locking a relative rotation phase at an intermediate phase based on an engine halt signal. The valve opening-closing timing control device has a relative rotation control mechanism including the first path for supplying or discharging oil to or from the retard angle chamber and the advance angle chamber and for moving a relative rotation phase between the retard angle chamber and the advance angle chamber in the range between the most retarded angle phase and the most advanced angle phase. The relative rotation control mechanism has a lock oil passage for actuating lock portions for locking the relative rotation phase at the intermediate phase between the most retarded angle phase and the most advanced angle phase. The second path is provided separately from the first path. The second path supplies oil to and discharges oil from a lock oil passage. ECU outputs, based on an engine halt signal, a command for discharging oil of the retard angle chamber and the advance angle chamber through the first path and for performing a main drain operation for discharging oil of a lock oil passage through the second path.

31 Claims, 17 Drawing Sheets

ADVANCE ANGLE CONTROL

INTERMEDIATE PHASE HOLD CONTROL

RETARD ANGLE CONTROL

VALVE TIMING CONTROL DEVICE

The present application is based on and claimed priority under 35.U.S.C. [119 with respect to Japanese Patent application No. 2001-371912 filed on Dec. 5, 2001, the entire content of which is incorporated herein by reference.

BACKGROUND OF THE INVENTION

1. Field of the Invention

This invention generally relates to a valve timing control device for controlling valve opening-closing timing of an engine that is installed in a vehicle and the like.

2. Description of the Related Art

Conventionally, a valve timing control device (Laid Open Japanese Patent No. 2001-41012, etc.) for controlling valve opening-closing timing of an engine in accordance with a driving condition of the engine is disclosed. This device includes the first rotary member for rotating integrally with a crank shaft of an engine, the second rotary member engaged with the first rotary member so as to form a fluid pressure chamber between the first rotary member and the second rotary member and rotating integrally with the cam shaft of the engine, a vane provided in the first rotary member or the second rotary member and separating the fluid pressure chamber into a retard angle chamber and an advance angle chamber; a relative rotation control mechanism for locking a relative rotation phase between the first rotary member and the second rotary member in an intermediate phase between the most retarded angle phase and the most advanced angle phase; and a hydraulic circuit having the first path for moving the relative rotation phase between the first rotary member and the second rotary member in the range between the most retarded angle phase and the most advanced angle phase by supplying or discharging oil to or from the advance angle chamber or the retard angle chamber at the time of releasing the lock condition.

With regard to the conventional invention, since the relative rotation phase between the first rotary member and the second rotary member can be adjusted between the most retarded angle phase and the most advanced angle phase in accordance with the driving condition of the engine, timing of opening-closing the engine can be controlled. Further, when the relative rotation phase becomes the intermediate phase between the most retarded angle phase and the most advanced angle phase, the device is set so as to improve the efficiency of starting the engine. Then, the relative rotation phase can be locked at the intermediate phase between the most retarded angle phase and the most advanced angle phase and thus the efficiency of starting the engine can be improved.

According to the above mentioned conventional technology, a relative rotation control mechanism has the first path for moving the relative rotation phase between the first rotary member and the second rotary member in a range between the most retarded angle phase and the most advanced angle phase by supplying or discharging oil to or from the advance angle chamber or the retard angle chamber, a lock portion for locking the relative rotation phase between the first rotary member and the second rotary member in the intermediate phase between the most retarded angle phase and the most advanced angle phase, and a lock oil passage for actuating the lock portion by oil pressure.

According to the above mentioned conventional technology, oil of the first path for supplying oil to or discharging oil from the retard angle chamber or the advance angle chamber is introduced into a lock oil passage directly.

Oil pressure of the advance angle chamber or the retard angle chamber connected to the first path may fluctuate by a cam fluctuation torque. In the above prior device, since the oil of the first path is introduced into the lock oil passage, the oil pressure in the lock oil passage is affected by the fluctuation of the oil pressure in the first path and thereby the operation of the lock portion gets unstable. Therefore, it is impossible to operate the lock portion for improving an ability of starting the engine next in time.

The present invention is achieved by progressing further the above prior art, the efficiency of discharging oil of the lock oil passage can be improved when the relative rotation phase is locked by the engine halt signal. The object of the present invention is to provide the valve opening-closing timing control device capable of locking the relative rotation phase rapidly at the intermediate phase, even if the revolving speed of the engine decreases.

SUMMARY OF THE INVENTION

A valve timing control device of the present invention is characterized in that, for the device having a first rotary member for rotating integrally with one of a cam shaft and a crank shaft of an engine; a second rotary member being engaged with the first rotary member so as to form a fluid pressure chamber between the first rotary member and the second rotary member and rotating integrally with another member of the cam shaft and the crank shaft of the engine; a vane being provided in the first rotary member or the second rotary member and separating the fluid pressure chamber into a retard angle chamber and an advance angle chamber; and a relative rotation control mechanism having a first path for moving a relative rotation phase between the first rotary member and the second rotary member in a range between a most retarded angle phase and a most advanced angle phase by supplying or discharging oil to or from the advance angle chamber and/or the retard angle chamber, a lock portion for locking a relative rotation phase between the first rotary member and the second rotary member in an intermediate phase between the most retarded angle phase and the most advanced angle phase, and a lock oil passage for actuating the lock portion, the device of the present invention includes: a second path, which is provided separately from the first path and connected to the lock oil passage, for supplying or discharging oil to or from the lock oil passage; and a control means for discharging oil from one or both of the retard angle chamber and the advance angle chamber based on an engine halt signal and performing a drain operation for discharging oil from the lock oil passage through a second path.

With regard to the valve opening-closing timing control device of the present invention, oil is supplied to and/or discharged from the retard angle chamber or the advance angle chamber through the first path. Accordingly, the relative rotation phase between the first rotary member and the second rotary member can be moved in the range between the most retarded angle phase and the most advanced angle phase. If the relative rotation phase between the first rotary member and the second rotary member is moved to the intermediate phase between the most retarded angle phase and the most advanced angle phase, the lock portion locks the relative rotation phase.

Oil is supplied to and/or discharged from the lock oil passage through the second path provided separately from the first path. Since the second path is provided separately from the first path, while the fluctuation of the oil pressure of the retard angle chamber and the advance angle chamber can be avoided, the efficiency of discharging oil of the lock oil passage can be improved, at the time of locking the relative rotation phase at the intermediate phase by the engine halt signal. Therefore, even if the revolving speed of the engine decreases since the engine is stopped by the engine halt signal, the relative rotation phase can be locked at the intermediate phase rapidly and excellently.

BRIEF DESCRIPTION OF THE DRAWING

The foregoing and additional features and characteristics of the present invention will become more apparent from the following detailed description considered with reference to the accompanying drawing figures wherein.

DESCRIPTION OF THE PREFERRED EMBODIMENTS

Figure 1:
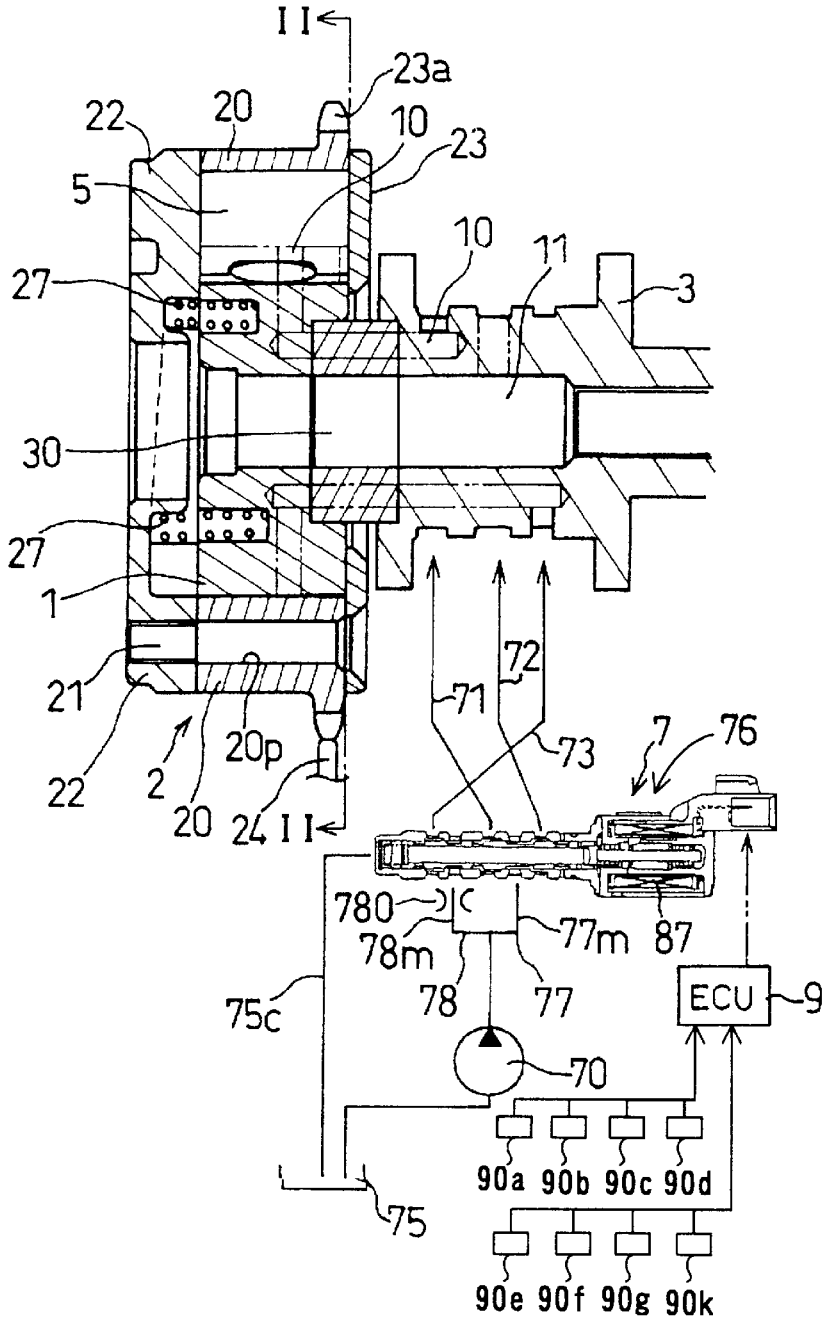
FIG. 1 is a total structure of valve timing control device.

The embodiments of the present invention are explained hereinafter with reference to drawings.

A relative rotation control mechanism has a hydraulic circuit. The hydraulic circuit can adopt an aspect having a hydraulic control valve for performing a main drain operation as a spool moves. The hydraulic control valve can adopt an aspect having an intermediate phase holding control position for holding the relative rotation phase at an intermediate phase, an advance angle control position for moving the relative rotation phase in the advance angle direction, and a structure of switching the main drain control position for performing the main drain operation as the spool moves. In this case, when the spool moves towards the drain control position because of performing the main drain operation by the engine halt signal, the advance angle control position is passed. In this way, when the spool moves towards the drain control position and the advance angle control position is passed, a noise for moving the relative rotation phase in the advance angle direction is caused. Thus, if the spool moves towards the drain control position through the advance angle control position by the engine halt signal and the main drain operation is performed as mentioned in the above, a control means changes a target value of the relative rotation phase into "an intermediate phase $-\alpha$." The meaning of "$-\alpha$" is a setting value of moving the relative rotation phase (the vane) in the retard angle direction. Accordingly, the noise towards the advance angle and "$-\alpha$" are cancelled or actually offset, and thus influence caused by the above mentioned noise can be suppressed. Consequently, if the engine halt signal is output, the relative rotation position can move rapidly to the intermediate phase as a lock position.

Further, the hydraulic control valve as different type from the above mentioned hydraulic control valve can adopt an embodiment having an intermediate phase hold position for holding the relative rotation phase at the intermediate phase, a retard angle control position for moving the relative rotation phase in the retard angle direction, and the main drain control position for performing the main drain operation. Further, the hydraulic control valve can adopt an embodiment having a function of switching the intermediate phase hold position, the retard angle control position, and the drain control position as the spool moves. According to this different type of hydraulic control valve, the retard angle control position is passed when the spool moves towards the drain control position since the drain operation is performed by the engine halt signal. In this way, when the spool moves towards the drain control position and passes through the retard angle control position, a noise for moving the relative rotation phase in the retard angle direction is caused. Thus, when the spool moves towards the drain control position through the retard angle control position by thus described engine halt signal, a control means changes a target value of the relative rotary position into "an intermediate phase $+\alpha$." The meaning of "$+\alpha$" is a setting value so as to move the relative rotation phase (the vane) in the advance angle direction. Accordingly, the noise towards the retard angle and "$+\alpha$" are cancelled and actually offset, and influence caused by the above mentioned noise can be suppressed. Consequently, if the engine halt signal is output, the relative rotation phase can move rapidly to the intermediate phase as the lock position.

When the drain operation is performed by the engine halt signal, if oil remains in the lock oil passage, a response from a lock portion may be delayed. Thus, the control means, for the above mentioned advance angle control position, can adopt an aspect for outputting a command for moving the relative rotation phase in the advance angle direction and discharging oil from the lock oil passage. Accordingly, the efficiency of discharging oil from the lock oil passage can be improved and a delayed response from the lock portion can be suppressed. Thus, an advantageous point for locking the relative rotation phase with great speed can be obtained.

When the drain operation is performed by the engine halt signal, if oil remains in the lock oil passage, the response from the lock portion may be delayed. Thus, for some kinds of the hydraulic control valve, the control means can adopt an aspect for outputting a command for moving the relative rotation phase in the retard direction and discharging oil from the lock oil passage, in the above mentioned retard angle control position. Accordingly, the efficiency of discharging oil from the lock oil passage can be improved and a delayed response from the lock portion can be suppressed. Thus, an advantageous point for locking the relative rotation phase with great speed can be obtained.

If the relative rotation phase is apart from the intermediate phase as the lock position, the distance in which the relative rotation phase moves to the intermediate phase is large. If the temperature of the engine is low, the viscosity of oil becomes high. Thus, the efficiency of discharging oil from the lock oil passage is influenced. If the revolving speed of the engine is high, the revolving speed of an oil pump is high. Thus, since the oil pressure of the engine is maintained, control time and opening of a port of the hydraulic control valve can be small. Further, in the case of automatic transmission, when the engine halt signal is output, the load of the engine for "D range" is larger than "N" range for the shift range. Thus, the revolving speed of the engine decreases rapidly. Thus, the control means can adopt an aspect in which a control value for the movement of spool of the hydraulic control valve can be modified based on one or more information from information at the time of outputting the engine halt signal, that is to say, a relative rotation phase (i.e., the phase of a vane), the condition of temperature of the engine, the revolving speed of the engine, and a shift range. This information can be used as instant information at the time of outputting the engine halt signal. Accordingly, even if the revolving speed of the engine decreases by the engine halt signal, the efficiency of detecting information can be maintained. With respect to the control value for the movement of the spool of the oil control valve, at least one example can be indicated from the control value of the quantity of supplying electricity (the duty ratio, etc.) to a solenoid for moving a solenoid and the control value of supplying electricity as control time.

The control means can adopt an aspect for outputting a command for performing a drain acceleration control for accelerating the efficiency of discharging oil from the lock oil passage up to the time of ending the main drain operation from the time of starting the engine halt signal. Accordingly, the efficiency of discharging oil of the lock oil passage can be improved. Even if the oil temperature of the engine is low, a delayed response from the lock portion can be suppressed, and an advantageous points for locking rapidly the relative rotation phase by the lock portion can be obtained.

The control means can adopt an aspect for outputting a command for performing a drain acceleration control of oil of the lock oil passage at the time of performing the main drain operation. Otherwise, for some kinds of the hydraulic control valve, the control means can adopt an aspect for outputting a command for performing a drain acceleration control of oil of the lock oil passage before the main drain operation is performed. Accordingly, the efficiency of discharging oil of the lock oil passage can be improved, a delayed response from the lock portion can be suppressed. Even if the oil temperature of the engine is low, an advantageous point for locking the relative rotation phase with great speed can be obtained. The drain acceleration control can adopt a means for improving the efficiency of discharging oil from the lock oil passage by increasing the volume of the opening (the opening area and/or the opening time) of a port connected to the lock oil passage of the hydraulic control valves. Further, the drain acceleration control can adopt a means for improving the efficiency of discharging oil from the lock oil passage by setting input time for lengthening the opening time of the port connected to the lock oil passage of oil control valves. The input time can be set before the relative rotation phase, for the advance angle control position, is moved in the advance angle direction and oil is discharged from the lock oil passage. Otherwise, the input time can be set before the relative rotation phase, for the retard angle control position, is moved in the retard angle direction and oil is discharged from the lock oil passage. Accordingly, an advantageous point for discharging oil from the lock oil passage can be improved, and a delayed response from the lock portion can be suppressed.

The vane can be fixed to the first rotary member or the second rotary member. Otherwise, the vane can be formed integrally with the rotary member or the second rotary member.

[Embodiments]

Figure 2:
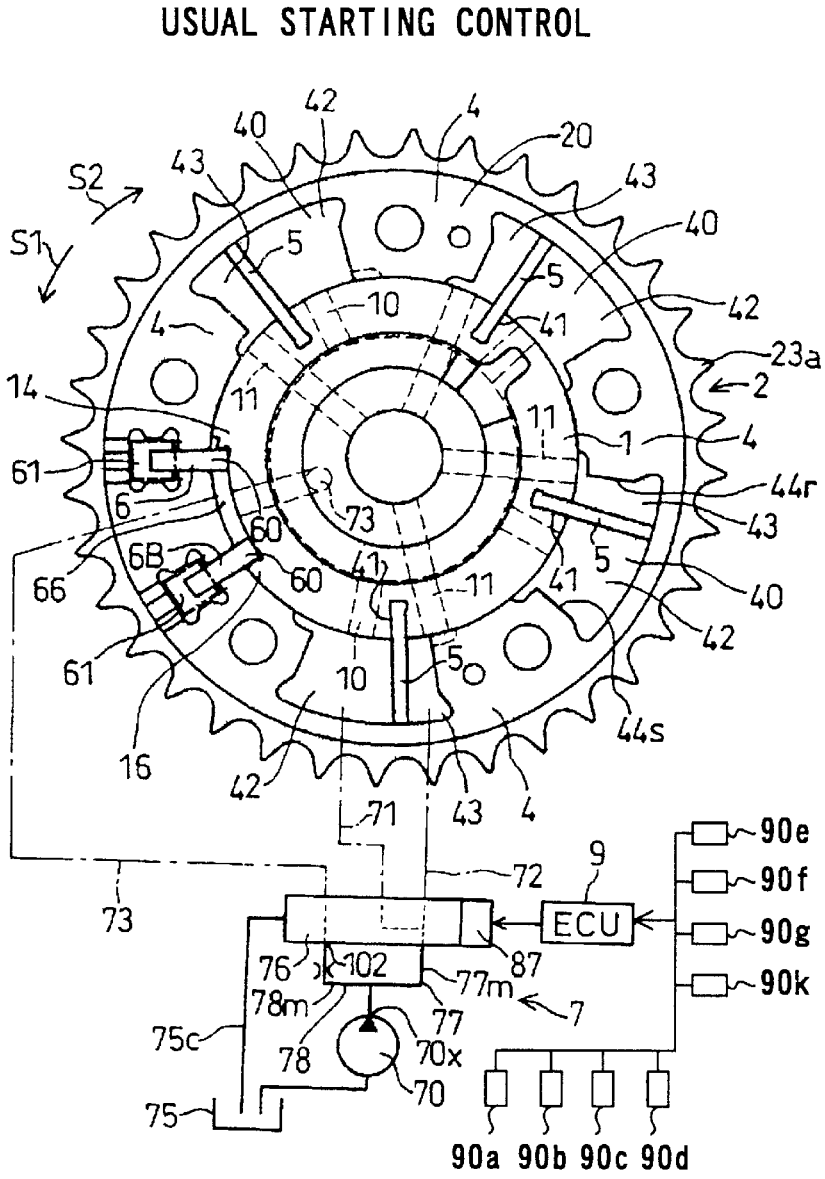
FIG. 2 is a sectional view taken along the line II—II of FIG. 1 and a sectional view of the valve opening-closing timing control device at the time of starting regularly.

In the following, the embodiments of the present invention are hereinafter explained with reference to drawings. The present embodiment is applied to a valve open-close timing control device of the side of an intake of an engine installed in a vehicle and the like. First of all, the whole structure of the valve open-close timing control device is explained. FIG 1 is a sectional view of the valve open-close timing control device along a longitudinal direction of a shaft of a cam shaft 3 having a cam for opening a valve of the engine. FIG. 2 is a sectional view of the valve open-close timing control device along a longitudinal direction of a shaft of a cam shaft 3. FIGS. 2 to 5 are drawn without using hatching lines in order to avoid complicity of the drawings.

(First embodiment)

The valve open-close timing control device in accordance with the present embodiment, as shown in FIG. 1, equips a rotor 1 that is installed in the engine and functions as the first rotary portion for opening and closing the valve of the engine and the second rotary portion 2 that engages in a relatively rotating way with the rotor 1. The rotor 1 is fixed by a fixing bolt 30 at a top end portion of the cam shaft 3 supported rotatably by a cylinder Block of the engine, and rotates integrally with the cam shaft 3. As shown in FIG. 2, the rotor 1 includes a retard angle path 10 connected to a shaft retard angle path along a shaft longitudinal direction of the cam shaft 3 and an advance angle path 11 connected to an advance angle path 11 along the shaft longitudinal direction of the cam shaft 3.

As shown in FIG. 1, the second rotary portion 2 includes a housing 20 enclosing the rotor 1 in a coaxial way, the first plate 22 fixed on one surface side of the housing 20 by a fixing bolt 21 passing through a bolt through hole 20*p* of the housing 20, and the second plate 23 fixed on another surface side of the housing 20 using a fixing bolt 21. The second plate 23 has a timing sprocket 23*a*. A timing chain or a transmission portion 24 such as a timing belt is provided between the timing sprocket 23*a* and the gear of a crank shaft of the engine. When the crank shaft of the engine is driven, the timing sprocket 23*a*, the second plate 23, the housing 20, and the rotor 1 rotate through the timing chain or the transmission portion 24 such as the timing belt, and then the cam shaft 3 integral with the rotor 1 rotates and the cam of the cam shaft 3 pushes up, opens, and closes the valve of the engine.

As shown in FIG. 2, plural thick convex portions 4, which function as shoes projecting towards the inside in the radial direction, are provided in the housing 20 as main portions of the second rotary portion 2. The projecting portion 4 has end portions 44*s* and 44*r* in the relatively rotating direction. Each of plural fluid pressure chambers 40, which is arranged in parallel along the relatively rotating direction (the directions of arrows S1 and S2), is formed between adjacent projecting portions 4. Plural fluid pressure chambers 40 are formed by the rotor 1 and the housing 20.

In the outer circumferential portion of the rotor 1, each of plural vane slots 41 is provided radially by each prescribed interval in order to face with each fluid pressure chamber 40. In each vane slot 41, a vane 5 functioning as a dividing portion is inserted in a sliding manner along the radial direction between respective vane slots 41. The number of the vanes 5 is the same as the number of the fluid pressure chambers 40. The position of the phase of the vane 5 indicates the position of the relative rotation phase between the rotor 1 and the housing 20. The direction of the movement of the vane 5 is the direction of the movement of the rotor 1. As shown in FIG. 2, the vane 5 divides each fluid pressure chamber 40 into a retard angle chamber 42 and an advance angle chamber 43 in the relative rotation directions (the directions of arrows S1 and S2) between the housing 20 and the rotor 1. The most retard phase angle is a phase in which the volume of the retard angle chamber 42 increases maximally. The most advance phase angle is a phase in which the volume of the advance angle chamber 43 increases maximally The advance angle chamber 43 of the fluid pressure chamber 40 is connected to the advance angle path 11 of the rotor 1. The retard angle chamber 42 of the fluid pressure chamber 40 is connected to the retard angle path 10 of the rotor 1.

As shown in FIG. 2, the prescribed length of the lock oil passage 66 is formed in the outer circumferential portion of the rotor 1. The retard angle direction stopper 14 is formed in the end of the lock oil passage 66 of the outer circumferential portion of the rotor 1. The retard angle direction stopper 14 prevents the rotor 1 from moving further in the retard angle direction (the direction of the arrow S1) to the housing 20 and also prevents the relative rotating phase from moving further in the retard angle direction (the direction of the arrow S1). The retard angle direction means a direction in which the timing of opening and closing the valve delays. The advance angle direction means a direction in which the timing of opening and closing the valve leads. An advance angle direction stopper 16 is formed in one end of the lock oil passage 66 of the outer circumferential portion of the rotor 1. The advance angle direction stopper 16 prevents the rotor 1 from moving further in the advance angle direction (the direction of the arrow S2) to the housing 20 and also prevents the relative rotating phase from moving further in the advance angle direction (the direction of the arrow S2).

As shown in FIG. 2, a lock portion 6B and a lock portion 6, which function as lock mechanisms for keeping the relative rotation phase between the rotor 1 and the housing 20 in an intermediate phase between the phase of rotating towards the most retarded angle side and the phase of rotating towards the most advanced angle side, are installed in the projecting portion 4 of the housing 20. The lock mechanism is an element of the relative rotation control mechanism. The flock portion 6 (the lock portion for the retard angle) prevents the rotor 1 from moving further in the retard angle direction. The lock portion 6B (the lock portion for an advance angle) prevents the rotor 1 from moving further in the advance angle direction. The lock portion 6 for the retard angle includes a lock body 60 formed in the shape of a plate or a pin and a spring 61 having the actuating power for actuating the lock body 60 in the radial direction as the locking direction. The lock portion 6B for the advance angle includes, in the same way as the lock portion 6 for the advance angle, the lock body 60 formed in the shape of a plate or a pin and a spring 61 having the actuating power for actuating the lock body 60 in the radial direction as the locking direction. Here, the shape of the lock body 60 is not limited to the shape of the plate or the pin.

As shown in FIG. 2 when the oil pressure of the lock oil passage 66 is released, if the relative rotation phase between the housing 20 and the rotor 1 become the prescribed intermediate phase, the lock body 60 of the lock portion 6 for the retard angle moves automatically in the radial direction as the lock direction by the actuating power of the spring 61. At the same time, the top end portion of the lock body 60 engages and stops in the lock oil passage 66 and the lock body 60 of the lock portion 6B for the advance angle moves automatically in the radial direction as the lock direction by the actuating power of the spring 61. The relative rotation phase between the housing 20 and the rotor 1 can be locked by engaging and stopping the top and portion of the lock body 60 of the lock portion 6B for the advance angle in the lock oil passage 66. That is to say, the phase of the vanes can be locked. In the same way, the lock portion 6B for the advance angle can be locked. Here, the relative rotation phase between the housing 20 and the rotor 1 corresponds to the phase of the vane 5.

In this way, if the relative rotation phase between the housing 20 and the rotor 1 is locked, the housing 20 and the rotor 1 can rotate integrally. In this embodiment, as indicated in the above mentioned description, when the relative rotation phase between the housing 20 and the rotor 1 becomes the intermediate phase between the most advanced angle phase and the most retarded angle phase, i.e., when the phase of the vane 5 becomes the intermediate phase between the most advanced angle phase and the most retarded angle phase in the fluid pressure chamber 40, the timing point for opening and closing the valve of the engine is set in order for the engine to start smoothly.

In the case that the relative rotation phase between the housing 20 and the rotor 1 is changed according to the driving condition of the engine, the lock portion 6 for the retard angle and the lock portion 6B for the advance angle are released. In this case, oil is provided in the lock oil passage 66 by way of a release path 73, a pressure surface of the top end portion of the lock body 60 of the lock portion 6 for the retard angle is pressed by the oil pressure of the lock oil passage 66 and then the locked condition is released by moving the lock body 60 towards the outside in the radial direction. In this way, if the lock condition of the lock portions 6 and 6B is released, the relative rotation of the housing 20 and the rotor 1 becomes possible. Thus, the rotation phase of the cam shaft 3 to the rotation phase of the crank shaft is adjusted in the retard angle direction (the direction of the arrow S1) or the advance angle direction (the direction of the arrow S2) in accordance with the driving condition of the engine and the output property of the engine can be adjusted.

FIG. 2 indicates the valve opening-closing timing control device at the time of starting usually. At the time of starting usually, the retard angle chamber 42 and the advance angle chamber 43 are drained and oil is drained. The lock oil passage 66 is also drained and oil is drained, thus the lock portions 6 and 6B move towards the inside in the radial direction and locked. Thus, it is possible to start the engine at the intermediate phase position for avoiding the relative rotation and setting in order for the starting characteristic to become excellent.

Figure 3:
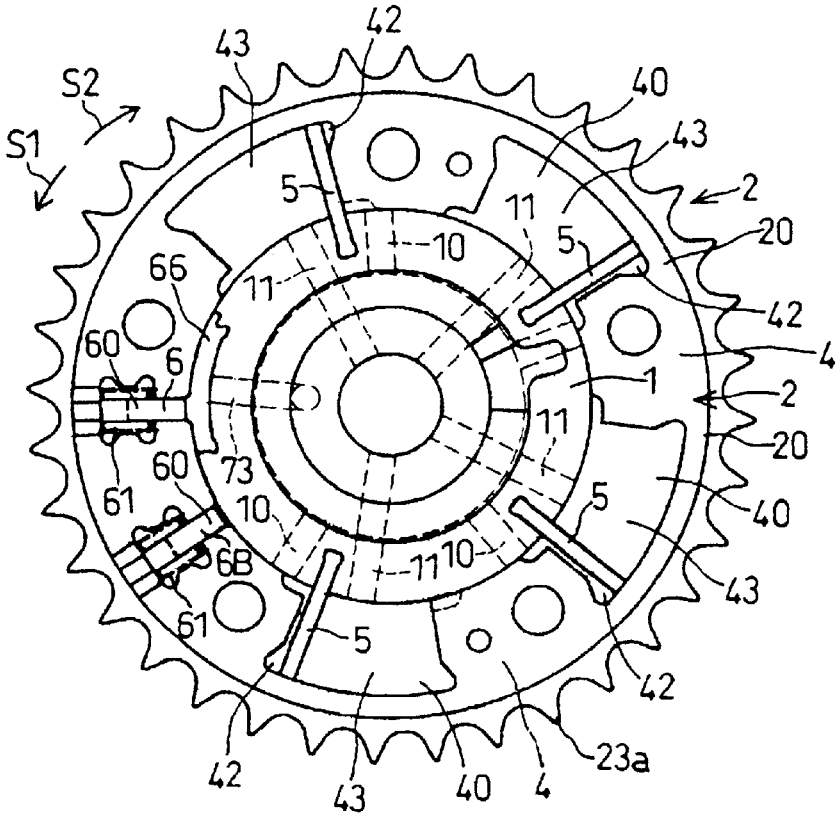
FIG. 3 is a sectional view of the valve opening-closing timing control device at the time of controlling the advance angle.

FIG. 3 indicates the valve opening-closing timing control device at the time of controlling the advance angle. At the time of controlling the advance angle, the relative rotation phase between the housing 20 and the rotor 1 moves in the advance angle direction, i.e., the vane 5 moves in the advance angle direction (the direction of the arrow S2). At the time of controlling the advance angle in such a way, oil is supplied in the lock oil passage 66 and the lock condition by the lock portions 6 and 6B is released. At the same time, although oil is supplied to the advance angle chamber 43, the retard angle chamber 42 is drained and oil of the retard angle chamber 42 is exhausted.

Figure 4:
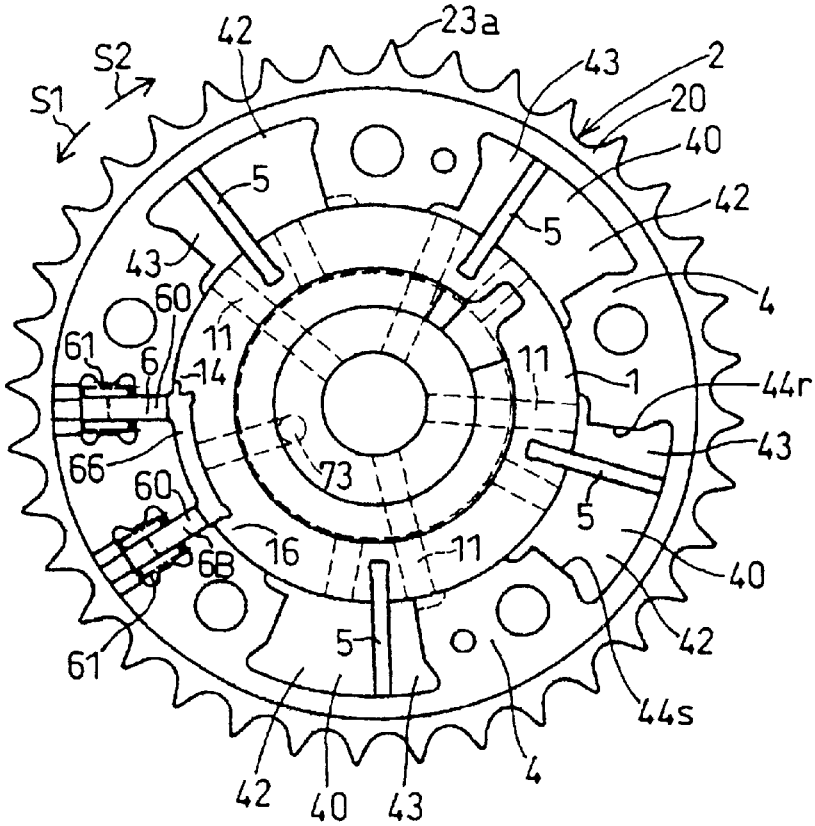
FIG. 4 is a sectional view of the valve opening-closing timing control device at the time of the intermediate phase hold control.

FIG. 4 indicates the valve opening-closing timing control device at the time of controlling and holding the intermediate phase. At the time of controlling and holding the intermediate phase, a hydraulic control valve 76 is controlled in order for oil of the retard angle chamber 42 and the advance angle chamber 43 not to be drained outside in the condition in which oil has been supplied. At the time of controlling and holding the intermediate phase in this way, oil is supplied to the lock oil passage 66 as well, the lock portions 6 and 6B move towards outside in the radial direction, and thus the lock condition is released.

Figure 5:
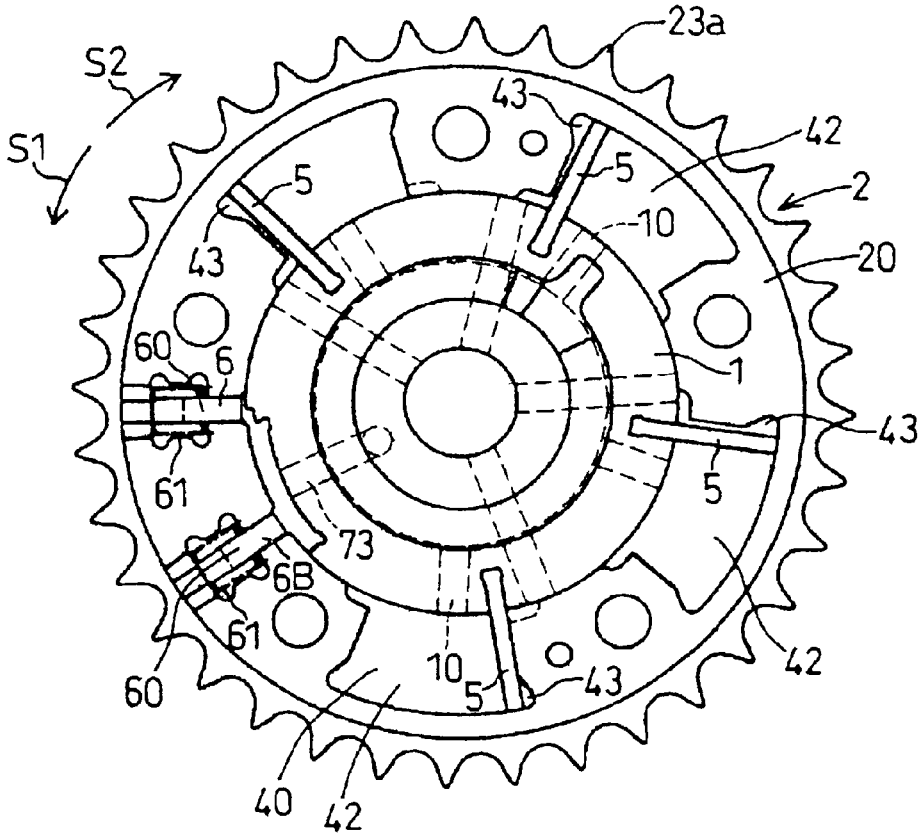
FIG. 5 is a sectional view of the valve opening-closing timing control device at the time of controlling the retard angle.

FIG. 5 indicates the valve opening-closing timing control device at the time of controlling the retard angle phase. At the time of controlling the retard angle phase, the relative rotation phase between the rotor 1 and the housing 20 moves in the retard angle direction, i.e., the vane 5 moves in the retard angle direction (the direction of the arrow S1). At the time of controlling the retard angle phase in this way, oil is supplied to the lock oil passage 66 and the lock condition by the lock portions 6 and 6B is released. At the same time, although oil is supplied to the retard angle chamber 42, the advance angle chamber 43 is drained and oil of the advance angle chamber 43 is exhausted.

A relative rotation control mechanism includes the above mentioned lock mechanism and a hydraulic circuit 7. The hydraulic circuit 7 is herein explained furthermore. As shown in FIG. 2, the hydraulic circuit 7 includes an oil pump 70 for supplying oil by the driving power of the engine, an oil pan 75 as an oil gathering portion for gathering oil exhausted by way of an exhaust passage 75*c*, the hydraulic control valve 76 for changing the volume of stroking of a spool by the quantity (the duty ratio) of supplying electricity to a solenoid 87, the first path 77 for supplying or discharging oil to or from an advance angle path 72 connected to the advance angle chamber 43 by way of the advance angle path 11 or a retard angle path 71 connected to the retard angle chamber 42 by way of the retard angle path 10 and the second path 78 that is connected to the lock oil passage 66 by way of a release path 73 and for supplying or discharging oil to or from the lock oil passage 66. The second path 78 has an orifice 780 between the hydraulic control valve 76 and the oil pump 70. The orifice 780 may be installed in the hydraulic control valve 76.

As obviously seen in FIG. 2, the first path 77 includes a path portion connected to the retard angle chamber 42 and a path portion connected to the advance angle chamber 43. The path portion of the first path 77, which is connected to the retard angle chamber 42, includes an oil feeding passage 77*m* connecting to the oil pump 70 and the hydraulic control valve 76, the retard angle path 71, and the retard angle path 10 of the rotor 1.

As seen in FIG. 2, the path portion of the first path 77, which is connected to the advance angle chamber 43, includes an oil feeding passage 77*m* connecting to the oil pump 70 and the hydraulic control valve 76, the advance angle path 72, and the advance angle path 11. The second path 78 includes an oil feeding passage 78*m*, which is connected to the oil pump 70 and another port of the hydraulic control valve 76, and the release path 73 connected to the lock oil passage 66. The second path 78 supplies oil to the lock oil passage 66 by way of the release path 73 by supplying oil to the second path 78, and thereby the lock portions 6 and 6B are actuated towards the outside in the radial direction, i.e., in the direction of releasing the lock condition.

In accordance with the present embodiment, the second path 78 is provided separately from the first path 77. As seen in FIG. 2, the oil feeding passage 77*m* of the first path 77 and the oil feeding passage 78*m* of the second path 78 are arranged in parallel with each other between the port 102 of the side of the intake of the hydraulic control valve 76 and a discharging port 70*x* of the oil pump 70. Further, the release path 73 of the second path 78, which led to the lock oil passage 66, is not connected to the retard angle path 71 of the first path 77, which is led to the retard angle chamber 42, and the advance angle path 72 of the first path 77, which is led to the advance angle chamber 43, between the rotor 1 (the housing 20) and the port of the side of discharging of the oil pump 70. They are separately connected with each other in parallel. The flow path, of the flow path inside the hydraulic control valve 76, in the side of supplying oil to the lock portion 6 is arranged in parallel with the flow path in the side of the retard angle path 71 and the advance angle chamber 43. Therefore, even if the oil pressure of the retard angle chamber 42 and the advance angle chamber 43 fluctuates, the fluctuating pressure is suppressed so as not to influence directly the lock oil passage 66.

Figure 6A:
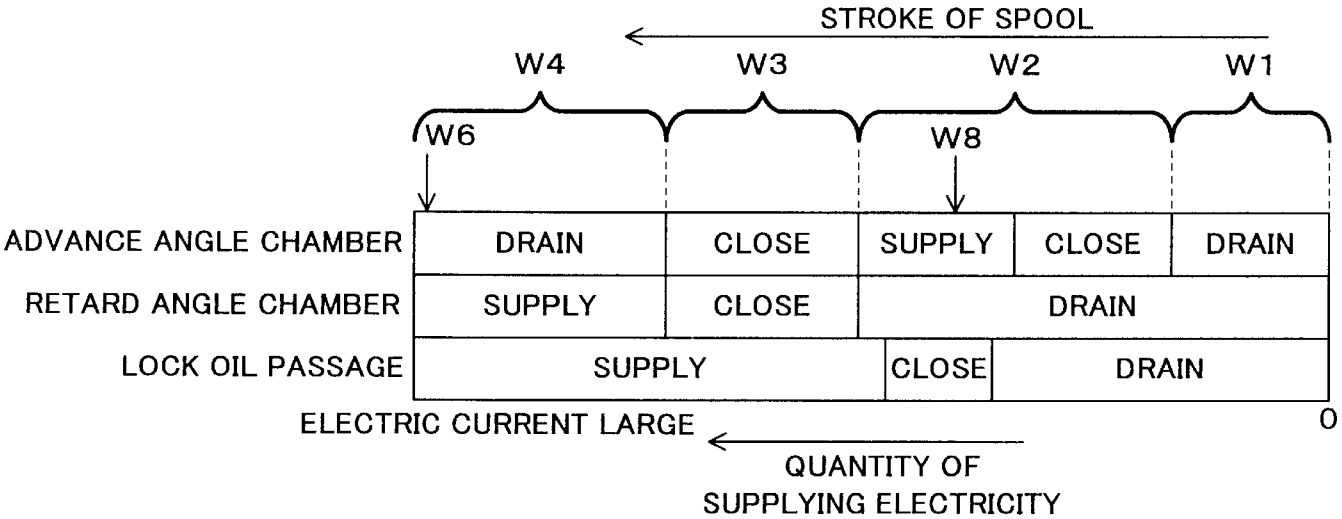
FIGS. 6A and 6B are representative process drawings of the relationship between actuation and the stroke of the spool of a hydraulic control valve.

FIG. 6A illustrates a representative example of the condition of actuating the hydraulic control valve 76 utilized in the present embodiment. As shown in FIG. 6A, the horizontal axis indicates the quantity of supplying electricity (the stroke of the spool) to the solenoid 87 of the hydraulic control valve 76. The meaning of drain is to discharge oil. If the quantity of supplying electricity is zero, the advance angle chamber 43 is drain, the retard angle chamber 42 is drain, and the lock oil passage 66 is drain. Accordingly, both of the advance angle chamber 43 and the retard angle chamber 42 are drained and further it is possible to perform the main drain operation for draining the lock oil passage 66. For the advance angle chamber 43, as the quantity of supplying electricity to the solenoid 87 of the hydraulic control valve 76 increases and then a spool 85 moves, it is set to drain the advance angle chamber 43, close the advance angle chamber 43, supply oil to the advance angle chamber 43, close the advance angle chamber 43, and drain the advance angle chamber 43. For the retard angle chamber 42, as the quantity of supplying electricity to the solenoid 87 of the hydraulic control valve 76 increase, it is set to drain the retard angle chamber 42, close the retard angle chamber 42, and supply oil to the retard angle chamber 42. For the lock oil passage 66, as the quantity of supplying electricity to the solenoid 87 of the hydraulic control valve 76 increase, it is set to drain the lock oil passage 66, close the lock oil passage 66, and supply oil to the lock oil passage 66.

In other words, the hydraulic circuit 7 can be an aspect including the hydraulic control valve 76 for performing the main drain operation as the spool 85 moves. The hydraulic control valve 76, as indicated in FIG. 6A, includes a retard angle control position W4 for moving the above mentioned relative rotation phase in the retard angle direction, an intermediate phase holding control position W3 for holding the relative rotation phase in the intermediate phase, an advance angle control position W2 for moving the above mentioned relative rotation phase in the advance angle direction, and a main drain control position W1 for performing the main drain operation. These positions W1 to W4 are switched as the spool 85 moves.

Figure 6B:
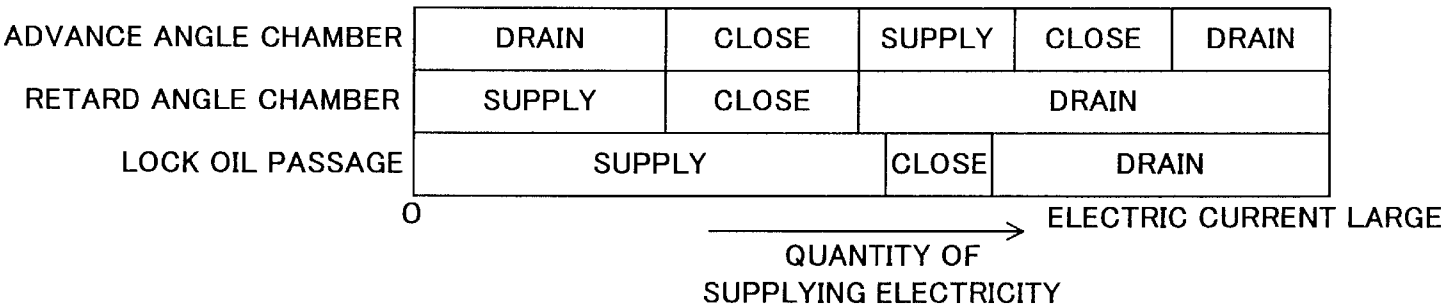

Here, FIG. 6A indicates the representative example of the condition of actuating the hydraulic control valve 76. The condition of actuation is not limited thereto, but can be modified freely in accordance with the required control. For example, FIG. 6B can be employed therefor.

Figure 7:
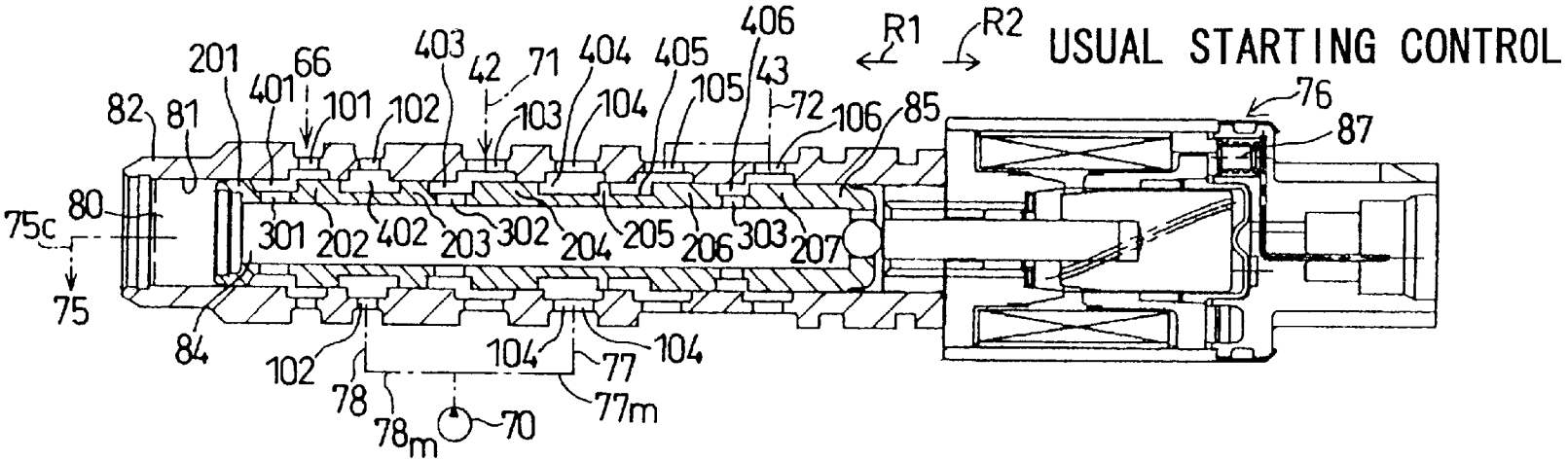
FIG. 7 is a sectional view for explaining the function of a hydraulic valve.

FIGS. 7 to 10 indicate the representative examples of the internal structures of the hydraulic control valve 76. Each of FIGS. 7 to 10 indicates the relationship between actuation and the stroke of the spool 85 of the hydraulic control valve 76. As shown in FIG. 7, the hydraulic control valve 76 includes a body 82 having a mobile chamber 81 and a discharge hole 80 connected to the oil pan 75, the spool 85 as a mobile body which has a hollow chamber 84 connected to the discharge hole 80 and is provided movably in a mobile chamber 81 of the body 82, and the solenoid 87 as the driving source for moving the spool 85 along the mobile chamber 81. The more the quantity of supplying electricity to the solenoid 87 increases, the more the spool 85 moves in one direction, i.e., in the direction of the arrow R1. The more the quantity of supplying electricity to the solenoid 87 decreases, the more the spool 85 moves in another direction, i.e., in the direction of the arrow R2. The body 82 includes the first port 101, the second port 102, the third port 103, the fourth port 104, the fifth port 105, and the sixth port 106. Oil is supplied to the fourth port 104 through the oil feeding passage 77*m* of the first path 77 from the oil pump 70. Oil is supplied to the second port 102 through the oil feeding passage 78*m* of the second path 78 from the oil pump 70. The spool 85 includes the first land 201, the second land 202, the third land 203, the fourth land 204, the fifth land 205, the sixth land 206, and the seventh land 207. The spool 85 includes the first hole 301, the second hole 302, and the third hole 303. The spool 85 includes the first groove 401, the second groove 402, the third groove 403, the fourth groove 404, the fifth groove 405, and the sixth groove 406, each of which has the shape of a ring.

FIG. 7 indicates the hydraulic control valve 76 at the time of not using and not driving the oil pump 70 (the stroke P1 of the spool 85). As shown in FIG. 7, the lock oil passage 66 is linked in series to the first port 101, the first groove 401, the first hole 301, the hollow chamber 84, the discharge hole 80, and the exhaust passage 75*c*. Oil of the lock oil passage 66 is discharged into the oil pan 75 by way of this passage. The retard angle chamber 42 is linked in series to the third port 103, the third groove 403, the second hole 302, the hollow chamber 84, the discharge hole 80, and the exhaust passage 75*c*. Oil of the retard angle chamber 42 is discharged into the oil pan 75 by way of this passage. The advance angle chamber 43 is linked in series to the sixth port 106, the sixth groove 406, the third hole 303, the hollow chamber 84, the discharge hole 80, and the exhaust passage 75*c*. Oil of the advance angle chamber 43 is discharged into the oil pan 75 by way of this passage. In FIG. 7, both of the fourth port 104 and the second port 102 connected to the oil pump 70 are closed.

Figure 8:
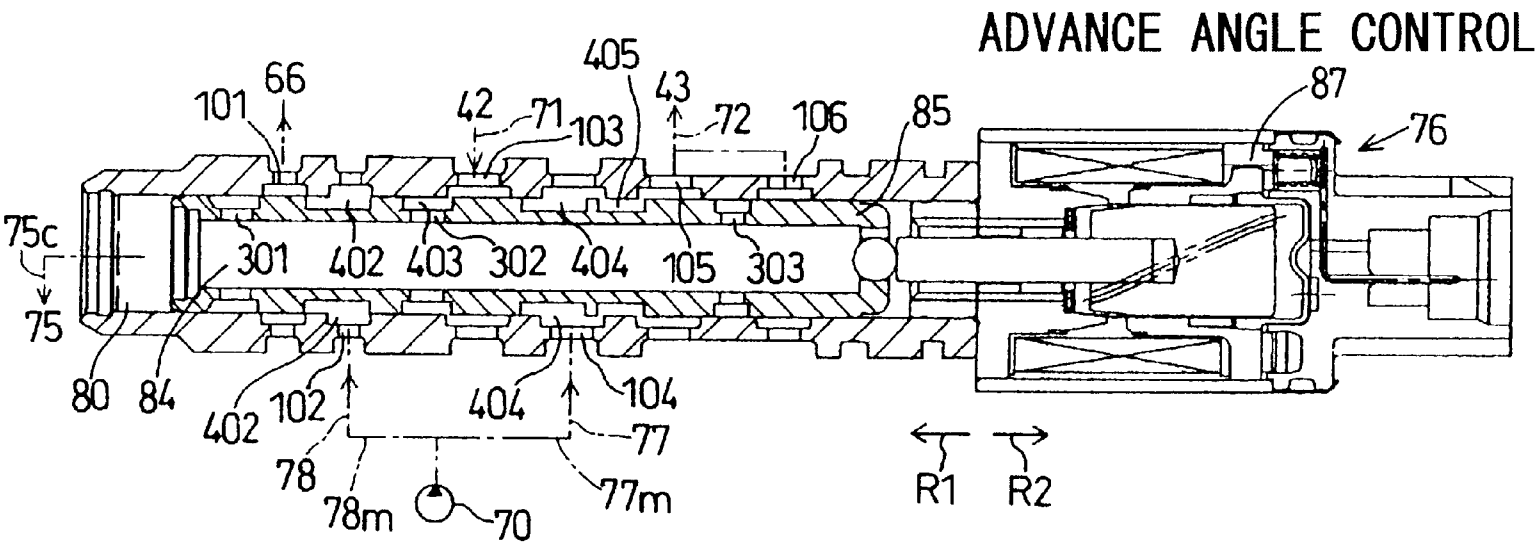
FIG. 8 is a sectional view for explaining the function of the hydraulic valve.

FIG. 8 indicates the hydraulic control valve 76 (the stroke P2 of the spool 85) at the time of controlling the advance angle. As shown in FIG. 8, oil of the oil pump 70 is supplied to the lock oil passage 66 by way of the oil feeding passage 78*m* of the second path 78, the second port 102, the second groove 402, and the first port 101, and thus the lock condition is released. Oil of the retard angle chamber 42 is discharged into the oil pan 75 by way of the retard angle path 71, the third port 103, the third groove 403, the second hole 302, the hollow chamber 84, and the discharge hole 80. Oil towards the advance angle chamber 43 from the first path 77 is supplied by way of the oil feeding passage 77*m* of the first path 77, the fourth port 104, the fourth groove 404 and by way of the fifth groove 405, the fifth port 105, and the advance angle path 72. Thus, oil is supplied to the advance angle chamber 43.

Figure 9:
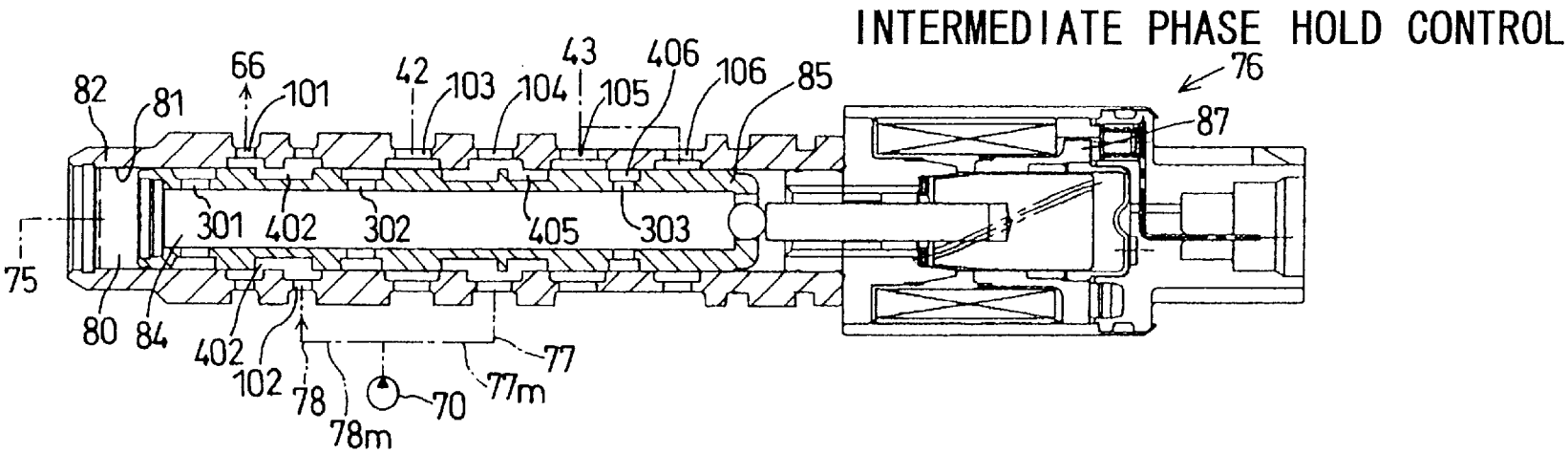
FIG. 9 is a sectional view for explaining the function of the hydraulic valve.

FIG. 9 indicates the hydraulic control valve 76 at the time of controlling and holding the intermediate phase (the stroke P3 of the spool 85). As shown in FIG. 9, oil of the oil pump 70 is supplied to the lock oil passage 66 by way of the oil feeding passage 78*m* of the second path 78, the second port 102, the second groove 402, and the first port 101. Accordingly, the lock condition is released by the oil pressure of the lock oil passage 66. Since the third port 103 connected to the retard angle chamber 42 and the fifth port 105 and sixth port 106 connected to the advance angle chamber 43 are closed, oil is not supplied to and not discharged from the retard angle chamber 42 and the advance angle chamber 43.

Figure 10:
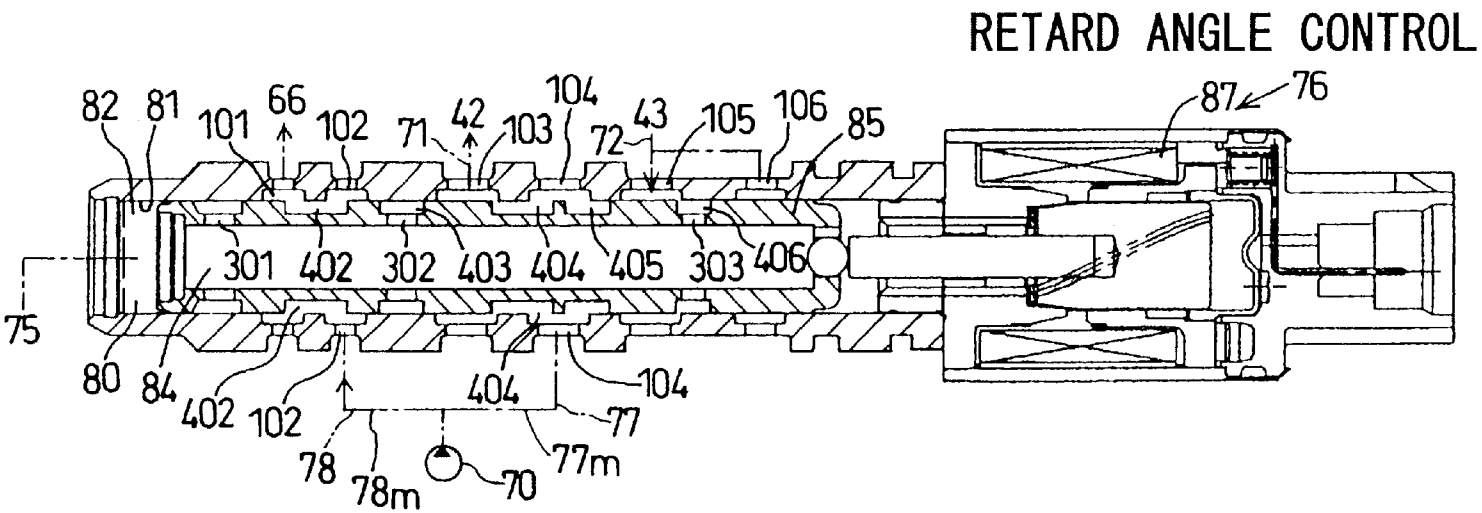
FIG. 10 is a sectional view for explaining the function of the hydraulic valve.

FIG. 10 indicates the hydraulic control valve 76 at the time of controlling the retard angle (the stroke P4 of the spool 85). As shown in FIG. 10, oil of the oil pump 70 is supplied to the lock oil passage 66 by way of the oil feeding passage 78*m* of the second path 78, the second port 102, the second groove 402, and the first port 101. Accordingly, the lock condition is released by the oil pressure of the lock oil passage 66. As shown in FIG. 10, oil of the oil feeding passage 77*m* of the first path 77 is supplied to the retard angle chamber 42 by way of the fourth port 104, the fourth groove 404, the third port 103, and the retard angle path 71. Oil of the advance angle chamber 43 is discharged into the oil pan 75 by way of the advance angle path 72, the fifth port 105, the third hole 303, the hollow chamber 84, the discharge hole 80, and the exhaust passage 75*c*. Here, each stroke of the spool 85 is defined as "P1<P2<P3<P4." Further, the internal structure of the hydraulic control valve 76 is not limited to the above mentioned structure but can be modified freely in accordance with the required control.

In this embodiment, as shown in FIG. 2, ECU (Electronic Control Unit) 9 is installed, which functions as a controlling means for supplying an electric current through a lead line to the solenoid 87 of the hydraulic control valve 76. ECU 9 includes built-in memories (RAM, ROM, etc.) utilized for storing computer executable programs, CPU, an input interface circuit, and an output interface circuit. Signals detected by various kinds of sensors are input to ECU 9, which are a cam angle sensor 90*a* for detecting the cam angle of the crank shaft, a crank angle sensor 90*b* for detecting the phase of the crank shaft, a vehicle speed sensor 90*c* for detecting the speed of the vehicle, a water temperature sensor 90*d* for detecting the temperature of cooling water for the engine, an oil temperature sensor 90*e* for detecting the temperature of oil for the engine, a revolving speed sensor 90*f* for detecting the speed of the engine, a throttle angle sensor 90*g* for detecting the opening of a throttle valve, an IG (Ignition) key switch 90*k* for controlling a start/stop operation of the engine, and so forth. The actual relative rotation phase between the rotor 1 and the housing 20 can be obtained from a cam angle obtained from the cam angle sensor 90*a* and the crank angle obtained from the crank angle sensor 90*b*.

Therefore, the cam angle sensor 90*a* and the crank angle sensor 90*b* can function as a VVT (Variable Value Timing) sensor for detecting the actual relative rotation phase (=the actual phase of the vane 5) between the rotor 1 and the housing 20.

The case of stopping the engine is further explained. In general, a driver operates, at the time of idling, the IG key switch 90*k* (an engine halt command means) and then stops the engine. In this case, an engine halt signal is input to ECU 9. For the idling condition, in accordance with the present aspect, while the relative rotation phase is maintained in the retard angle control condition, oil is not supplied to and not discharged from the retard angle chamber 42 and the advance angle chamber 43. Based on the engine halt signal, while ECU 9 drained oil from the advance angle chamber 43 and the retard angle chamber 42 by controlling the hydraulic control valve 76, oil is discharged from the lock oil passage 66. Consequently, when the engine halts, since the vane 5 reciprocates within the prescribed distance due to a cam fluctuation torque, the relative rotation phase between the rotor 1 and the housing 20 reciprocates. Therefore, when the relative rotation phase reached the intermediate phase, the lock portions 6 and 6B move automatically in the lock direction and thus locked. Consequently, the relative rotation phase between the rotor 1 and the housing 20 is locked in the intermediate phase. Thus, when the engine is started next in time, it is possible to start the engine at the intermediate phase for setting the engine so as to be started excellently. In this case, since oil of the retard angle chamber 42 and the advance angle chamber 43 is drained, the retard angle chamber 42 and the advance angle chamber 43 are empty or a nearly empty condition. Therefore, the vane 5 can be moved rapidly and further locking time can be shortened.

Figure 11:
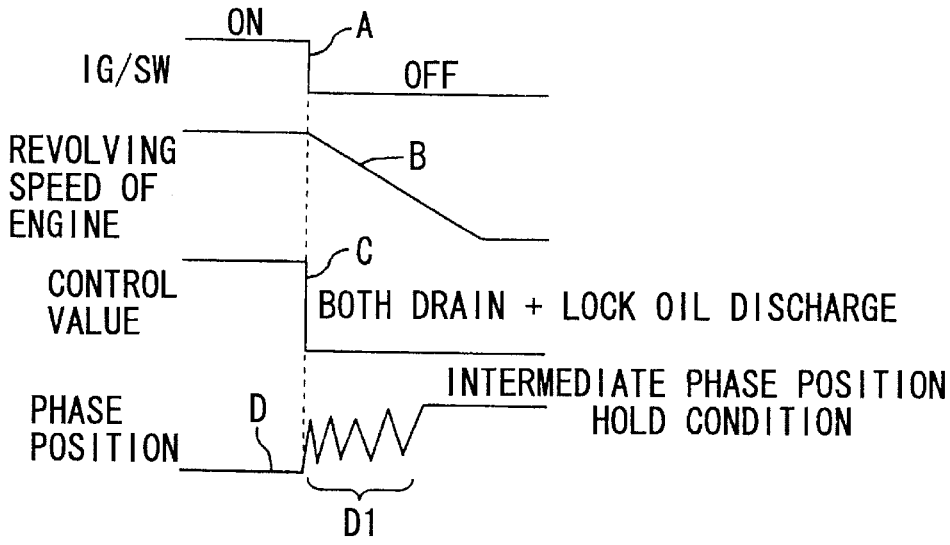
FIG. 11 is a timing chart of a control aspect 1.

ECU 9, in accordance with the present aspect, can perform the following controlling aspect. FIG. 11 is a timing chart of the first control aspect performed by ECU 9 at the time of stopping the engine. As shown in FIG. 11, when the Ignition (IG) key switch 90*k* (IG/SW) of the driver's seat is operated by the vehicle's driver at the time of idling, an engine halt signal A is input to ECU 9. Then, while the revolving speed of the engine is declined gradually as indicated in a property line B, the revolving speed of the oil pump 70 decreases, accordingly the oil pressure of the engine decreases gradually. In this case, ECU 9 outputs a control signal C containing a controlling value of the spool 85 to the solenoid 87 of the hydraulic control valve 76. The control signal C is a signal for draining both of the retard angle chamber 42 and the advance angle chamber 43 and for performing the main drain operation for draining the lock oil passage 66. That is to say, the control signal C is a signal for setting the quantity of supplying electricity to the solenoid 87 as zero and the hydraulic control valve 76 as the main drain control position W1 (refer to FIG. 6). Accordingly, the spool 85 moves in the direction of draining three elements of the retard angle chamber 42, the advance angle chamber 43, and the lock oil passage 66. Consequently, as described before, both of the retard angle chamber 42 and the advance angle chamber 43 are drained and further the lock oil passage 66 is drained. Then, the retard angle chamber 42 and the advance angle chamber 43 become empty or the nearly empty condition, the relative rotation phase (the vane 5) can reciprocate rapidly within the prescribed distance due to the cam fluctuation torque at the time of stopping the engine. Consequently, when the relative rotation phase becomes the intermediate phase, the lock portions 6 and 6B move automatically in the locking direction and then locked rapidly. Here, the waveform D1 of a characteristic line D of FIG. 11 represents that the vane 5 reciprocates within the prescribed distance due to the cam fluctuation torque.

Figure 12:
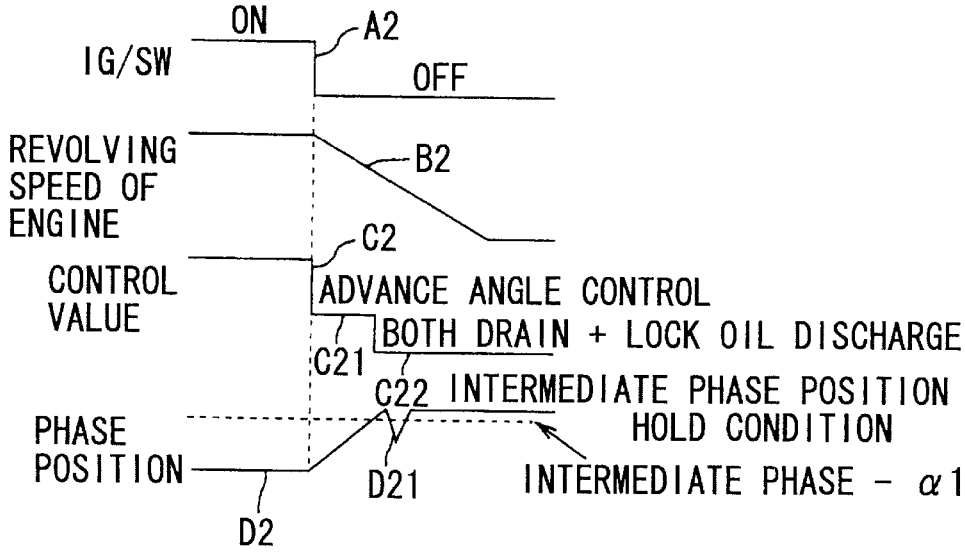
FIG. 12 is a timing chart of a control aspect 2.

FIG. 12 is a timing chart of the second control aspect performed by ECU 9 at the time of stopping the engine in the case that the relative rotation phase (the vane 5) is in the side of the retard angle. The phase of the vane 5 can be detected by the VVT sensor as mentioned before. As indicated in FIG. 12, if the IG key switch 90*k* is operated by the vehicle's driver in the idling condition, an engine halt signal A2 is input to ECU 9. Then, the revolving speed of the engine decreases gradually as indicated in a property line B2 and the oil pressure of the engine decreases gradually as well. In such a case, ECU 9 outputs a control signal C2 containing the control value of the spool 85 to the solenoid 87 of the hydraulic control valve 76. The control signal C2 is a signal for performing the main drain operation for draining the retard angle chamber 42, the advance angle chamber 43, and the lock oil passage 66. To give an actual example, the control signal C2 contains a control signal C21 for controlling the advance angle for moving the relative rotation phase in the advance angle direction and a control signal C22 for draining thereafter both of the retard angle chamber 42 and the advance angle chamber 43 and for performing the main drain operation of draining the lock oil passage 66 as well. Accordingly, the spool 85 controls the advance angle based on the control signal C21 first of all and moves the relative rotation phase (the phase of the vane 5) of the side of the retard angle phase in the advance angle direction. In this way, before the main drain operation is performed, the more the relative rotation phase (the vane 5) of the side of the retard angle phase moves in the advance angle direction, the more the phase approaches the intermediate phase as the lock position. Thus, time required for locking can be reduced. Next, based on the control signal C22, the retard angle chamber 42, the advance angle chamber 43, and the lock oil passage 66 are drained. In this way, if oil of the retard angle chamber 42, the advance angle chamber 43, and the lock oil passage 66 are drained and discharged, the retard angle chamber 42 and the advance angle chamber 43 become empty or the nearly empty condition. Then, since the relative rotation phase (the vane 5) can reciprocate rapidly within the prescribed distance due to the cam fluctuation torque at the time of stopping the engine, that is to say, since the relative rotation phase between the rotor 1 and the housing 20 can be caused easily, the lock portions 6 and 6B, in which the relative rotation phase (the phase of the vane 5) is the intermediate phase, move in the locking direction and locked rapidly.

Further, the control of FIG. 12 is explained. As obviously indicated in FIG. 6, if the engine halt signal is output when the relative rotation phase (the vane 5) is a delay angle phase W8 (an idling condition) and if the quantity of supplying electricity to the solenoid 87 is set to be zero, the main drain control position W1 is reached after the advance angle control position W2 is passed. In this way, since the main drain operation is performed based on the engine halt signal, when the spool 85 moves towards the main drain control position W1 and crosses the advance angle control position W2 on the way, a noise is caused, in which the relative rotation phase (the vane 5) moves in the advance angle direction. Thus, when the relative rotation phase (the vane 5) is moved to the intermediate phase and locked based on the engine halt signal, ECU 9 changes the target value for the relative rotation phase at the time of locking to "the intermediate phase $-\alpha 1$." The meaning of "$-\alpha 1$" is a value for setting the relative rotation phase (the vane 5) moving in the retard angle direction. This value can be selected experimentally or at the time of designing. Accordingly, a noise towards the advance angle and "−α1" are cancelled or offset actually, thus influence caused by the above mentioned noise is suppressed. Consequently, at the time of stopping the engine, the relative rotation phase (the phase of the vane 5) can reach the intermediate phase as the lock position rapidly, and the locking condition can be achieved rapidly by the lock portions 6 and 6B. In other words, the vane 5 can reduce the reciprocating number of the vane 5 based on the cam fluctuating torque. In FIG. 12, a waveform D21 of a property line D2 indicates that the reciprocating number of the vane 5 is small.

Figure 13:
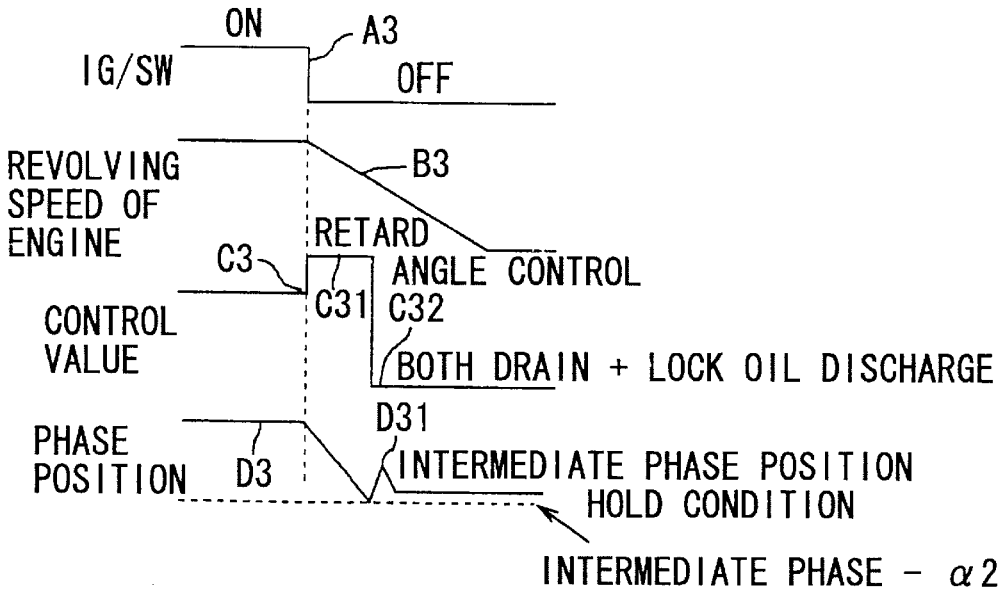
FIG. 13 is a timing chart of a control aspect 3.

FIG. 13 is a timing chart of the third control aspect performed by ECU 9 at the time of stopping the engine in the case that the relative rotation phase (the vane 5) is in the side of the advance angle. As indicated in FIG. 13, if the IG key, switch 90*k* is operated by the vehicle's driver, an engine halt signal A3 is input to ECU 9. Then, the revolving speed of they engine decreases gradually as indicated in a property line B3 and the oil pressure of the engine decreases gradually as well. In such a case, ECU 9 outputs a control signal C3 containing the control value of the spool 85 to the solenoid 87 of the hydraulic control valve 76. The control signal C3 contains a control signal C31 for controlling the retard angle for moving the relative rotation phase (the vane 5) in the retard angle direction and a control signal C32 for draining thereafter both of the retard angle chamber 42 and the advance angle chamber 43 and for performing the main drain operation of draining the lock oil passage 66 as well. In this way, if oil of the retard angle chamber 42, the advance angle chamber 43, and the lock oil passage 66 are discharged, due to the cam fluctuation torque at the time of stopping the engine, the relative rotation phase (the vane 5) reciprocates within the prescribed distance. Thus, if the relative rotation phase reaches the intermediate phase as the lock position, the lock portions 6 and 6B move in the lock position automatically and then locked. In FIG. 13, a waveform D31 of a property line D3 means that the reciprocating number of the vane 5 is small. Here, in the controlling aspect of FIG. 13, since the relative rotation phase (the vane 5) In the advance angle phase is moved in the retard angle direction before performing the main drain operation, the relative rotation phase (the vane 5) can approach rapidly the intermediate phase as the lock position and thus time required for locking can be reduced.

As obviously indicated in FIG. 6, if the engine halt signal is output when the vane 5 is an advance angle phase we and if the quantity of supplying electricity to the solenoid 87 is set to be zero, the spool 85 reaches the main drain control position W1 after the advance angle control position W2 is passed. In this way, when the spool 85 moves towards the main drain control position W1 and passes the advance angle control position W2 for a while, a noise is caused, in which the relative rotation phase (the vane 5) moves in the advance angle direction. Thus, when the relative rotation phase is moved to the intermediate phase (the position for starting the engine excellently) and locked based on the engine halt signal, ECU 9 outputs a command to the hydraulic control valve 76, for setting the target value of the relative rotation phase to "the intermediate phase −α2." Accordingly, a noise towards the advance angle and "−α2" are cancelled or offset actually, thus influence caused by the above mentioned noise is suppressed. Consequently, the relative rotation position (the vane 5) can reach rapidly the intermediate phase as the lock position, and the locking condition can be achieved rapidly by the lock portions 6 and 6B. In other words, the reciprocating number of the relative rotation phase (the vane 5) can be reduced based on the cam fluctuating torque. The meaning of "−α2" is a value for setting the relative rotation phase (the vane 5) moving in the retard angle direction. This value can be selected experimentally or at the time of designing. Here, the value of "α2" is set to be a smaller value than the above mentioned "α1."

Figure 14:
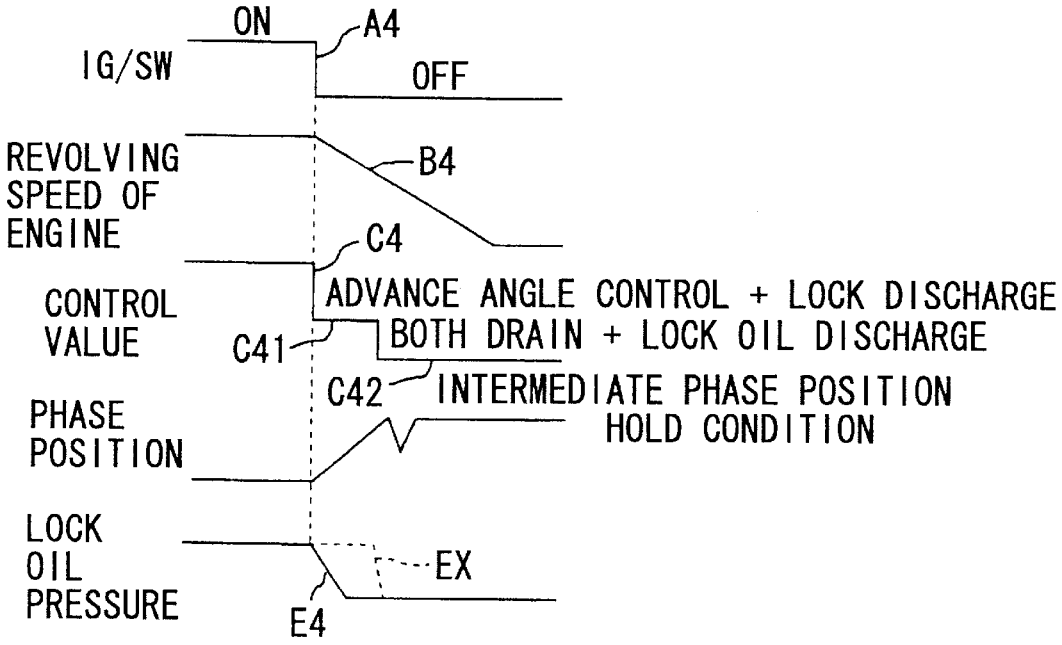
FIG. 14 is a timing chart of a control aspect 4.

FIG. 14 is a timing chart of the fourth-control aspect at the time of stopping the engine in the case that the vane 5 is in the side of the retard angle. As indicated in FIG. 14, if the IG key switch 90*k* is operated by the vehicle's driver in the idling condition, an engine halt signal A4 is input to ECU 9. Then, the revolving speed of the engine decreases gradually as indicated in a property line B4 and the oil pressure of the engine decreases gradually as well. After the engine has stopped, since the revolving speed of the oil pump decreases and the oil pressure of the engine decreases as well, the delayed locking movement of the lock portions 6 and 6B is not preferable. In such a case, ECU 9 outputs a control signal C4 containing the control value of the spool 85 to the solenoid 87 of the hydraulic control valve 76. The control signal C4 is a signal for performing a drain acceleration control. The control signal C4 includes the a control signal C41 for controlling the advance angle and discharging the lock oil passage 66 and a control signal C42 for draining both of the retard angle chamber 42 and the advance angle chamber 43 and for performing the main drain operation of draining the lock oil passage 66 as well. The control signal C41 controls the advance angle and discharges oil from the lock oil passage 66 as well. Therefore, oil is discharged rapidly from the lock oil passage 66 as indicated in a property line E4 of FIG. 14, when a discharge property EX (the case that the control signal C41 controls only the advance angle) of a comparative example of FIG. 14 is compared. Therefore, lock oil pressure can be reduced rapidly, and it is possible to actuate rapidly in the locking directions of the lock portions 6 and 6B. Accordingly, an advantageous point of locking rapidly the relative rotation phase at the intermediate phase can be obtained at the time of stopping the engine. If oil remains in the lock oil passage 66 at the time of performing the main drain operation by the engine halt signal, it may be delayed to actuate in the locking direction of the lock portions 6 and 6B, but normal operation can be performed without any trouble by controlling the above mentioned drain acceleration.

Figure 15:
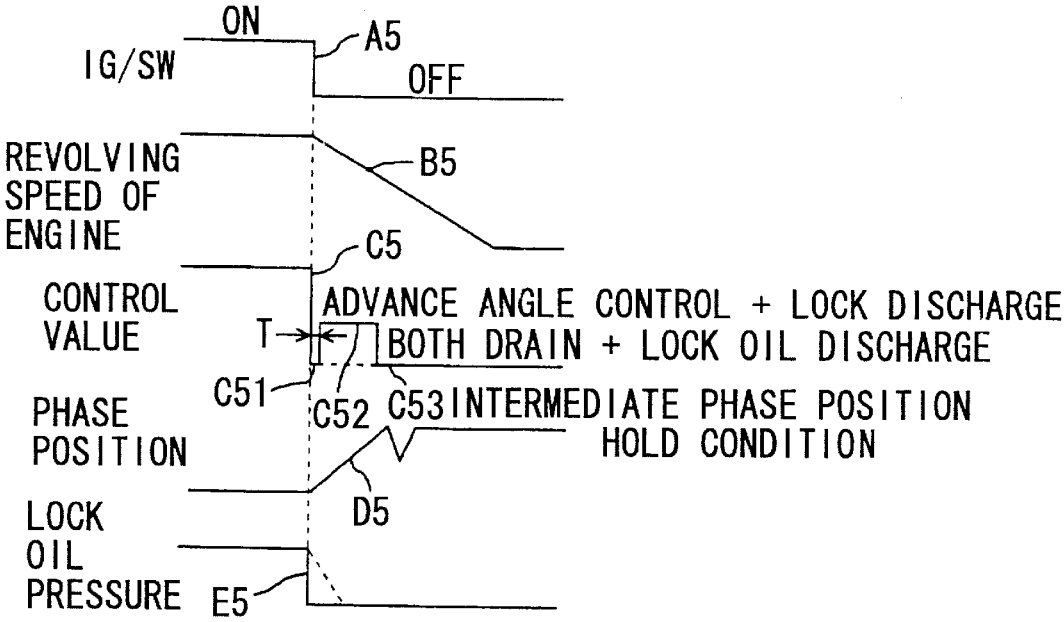
FIG. 15 is a timing chart of a control aspect 5.

FIG. 15 is a timing chart of the fifth control aspect at the time of stopping the engine in the case that the vane 5 is in the side of the retard angle. As indicated in FIG. 15, if the IG key switch 90*k* is operated by the vehicle's driver in the idling condition, an engine halt signal A5 is input to ECU 9. Then, the revolving speed of the engine decreases gradually as indicated in a property line B5 and the oil pressure of the engine decreases gradually as well. In such a case, ECU 9 outputs a control signal C5 containing the control value of the spool 85 to the solenoid 87 of the hydraulic control valve 76. The control signal C5 is a signal for performing a drain acceleration control. The control signal C5 includes the a control signal C51 for draining instantly the retard angle chamber 42, the advance angle chamber 43, and the lock oil passage 66, a control signal C52 for controlling the advance angle and draining the lock oil passage 66, and a control signal C53 for draining both of the retard angle chamber 42 and the advance angle chamber 43 and for performing the main drain operation of draining the lock oil passage 66 as well. Each control volume (the quantity of supplying electricity to the solenoid 87) of the control signals C51 and C53 is the same with each other. Time for inputting the control signal C51 is indicated by a reference character "T" and equals to flash time. Accordingly, it is possible to discharge oil rapidly from the lock oil passage 66, as indicated in a property line E5 of FIG. 15, at the time of outputting the engine halt signal. Further, it is suppressed to delay actuating the lock portions 6 and 6B in the locking direction, and an advantageous point for locking the relative rotation phase rapidly can be obtained.

Figure 16:
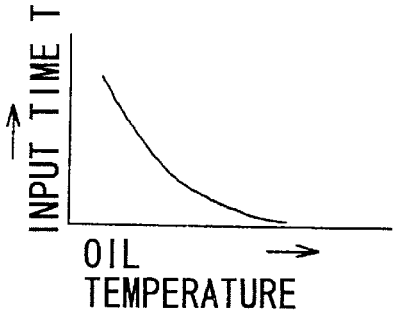
FIG. 16 is a timing chart of a control aspect 6.

When the temperature of the engine and cooling water is low, viscosity of oil is high. Thus, the lock oil passage 66 may be suppressed from discharging rapidly oil from the lock oil passage 66 and it may be delayed to actuate the lock portions 6 and 6B in the locking direction. Thus, in accordance with the sixth control aspect as indicated in FIG. 16, input time T as one of values for controlling the hydraulic control valve 76 is modified in accordance with the oil temperature of the engine. That is to say, the higher the oil temperature of the engine is, the less the input time T is. The lower the oil temperature of the engine is, the longer the input time T is. Accordingly, it is possible to deal with fluctuation of oil viscosity. The temperature of cooling water of the engine can be used instead of the oil temperature of the engine.

Figure 17:
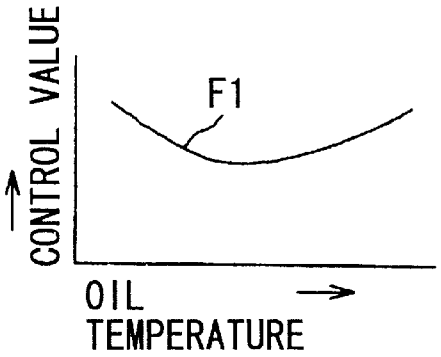
FIG. 17 is a timing chart of a control aspect 7.

As described in the above, the property of discharging oil is influenced by the temperature of oil. If the temperature of the engine is low, oil viscosity is high. Thus, the discharging condition of oil from the lock oil passage 66 may be restricted. Thus, according to the seventh control aspect as indicated in FIG. 17, the value (the quantity of supplying electricity, controlling time, and so forth) of controlling the spool 85 is variable in accordance with the temperature of the engine. That is to say, as indicated in a property line F1 of FIG. 17, the modifying operation is performed for maintaining the opening of a port by increasing the value of controlling the hydraulic control valve 76, as the oil temperature of the engine (or the water temperature of cooling water of the engine) becomes lower than the threshold temperature. Further, the value of controlling the hydraulic control valve 76 is increased, as the oil temperature of the engine (or the water temperature of cooling water of the engine) becomes higher than the threshold temperature. This control operation is performed in view of the fact that oil viscosity is low and thus oil is leaked if the oil temperature is high.

Figure 18:
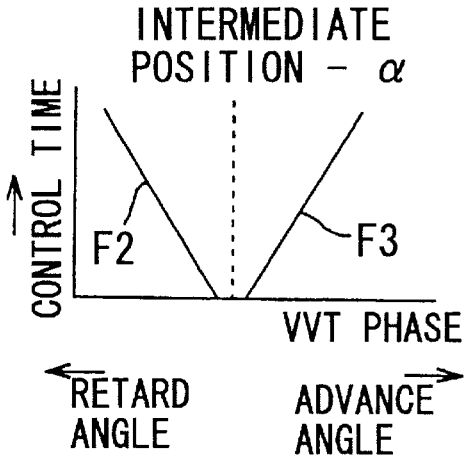
FIG. 18 is a timing chart of a control aspect 8.

If the position (the position of the vane 5) of the relative rotation phase is far from the position of the intermediate phase as the lock position, the distance increases for moving the position (the vane 5) of the relative rotation phase to the position of the intermediate phase as the lock position. Thus, according to the eighth controlling aspect as indicated in FIG. 18, while the target value of the relative rotation phase (the vane 5) is set to be "the intermediate phase $-\alpha$", as the position (the position of the vane 5) of the relative rotation phase is far from the position of the intermediate phase in the retard angle direction, time (time for opening the port of the hydraulic control valve 76) for controlling the spool 85 is lengthened in accordance with the lengthened distance, based on the property line F2. Further, as the position (the position of the vane 5) of the relative rotation phase is far from the position of the intermediate phase in the advance angle direction, time (time for opening the port of the hydraulic control valve 76) for controlling the spool 85 is lengthened in accordance with the lengthened distance, based on a property line F3.

Figure 19:
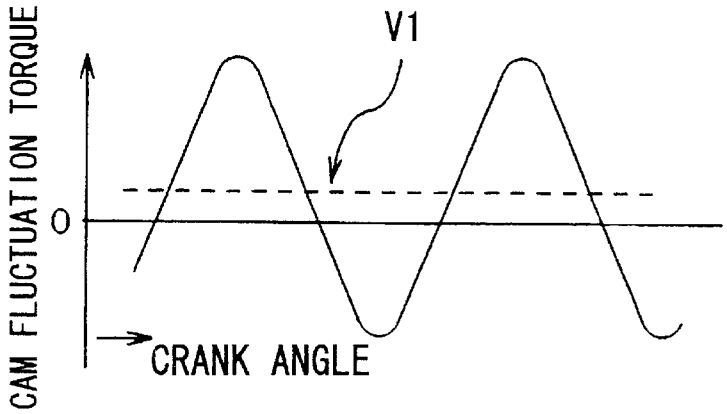
FIG. 19 is a graph of changing a torque of a cam fluctuation torque.

FIG. 19 indicates the change of the cam fluctuation torque of the engine to a crank angle. The reference character "V1" indicates an average value of the cam fluctuation torque. The average value V1 of the cam fluctuation torque has the actuating power towards the retard angle. In accordance with the valve opening-closing timing control device of the present aspect, a vane actuating spring 27 (refer to FIG. 1), which is formed by a torsion coil spring actuating the vane 5 usually in the advance angle direction, is provided between the rotor 1 and the housing 20. During the operation of an internal combustion engine, a cam of a cam shaft pushes up the valve of the internal combustion engine and opens it, thus the actuating power functions all the time in order to actuate the vane 5 in the retard angle direction. In this way, since the vane actuating spring 27 is provided for actuating the vane 5 in the advance angle direction, responsibility for functioning is guaranteed.

Thus, according to the eighth controlling aspect, the actuating power of the vane actuating spring 27 is set so as to correspond to the average value V1 of the cam fluctuation torque for actuating in the retard angle direction. That is to say, the average value of the actuating power of the vane actuating spring 27 is equal or nearly equal to the average value V1 of the cam fluctuation torque for actuating in the retard direction. In other words, the average value of actuating power of the vane actuating spring 27 is within ±20 percent of the average value V1 of the cam for actuating in the retard direction, especially within ±10 percent.

As explained in the above, according to the present aspect, since the second path 78 connected to the lock oil passage 66 is separated from the first path 77, when the lock portions 6 and 6B are actuated, an advantageous point for suppressing influence of fluctuation of the oil pressure of the advance angle chamber 43 and the retard angle chamber 42 caused by the cam fluctuation torque can be obtained as much as possible. Thus, the lock portions 6 and 6B can be actuated excellently.

According to the present aspect, when the relative rotation phase is locked at the intermediate phase based on the engine halt signal, while oil of both of the retard angle chamber 42 and the advance angle chamber 43 is discharged, the hydraulic circuit 7 performs the main drain operation for discharging oil of the lock oil passage 66. In this way, since the main drain operation is performed at the time of stopping the engine based on the condition of the engine being stopping, it is possible to discharge efficiently oil of both of the retard angle chamber 42 and the advance angle chamber 43. Thus, when the engine halt signal is output, the retard angle chamber 42 and the advance angle chamber 43 become rapidly empty or nearly empty. Therefore, even if the oil pressure becomes low due to the engine halt signal, it is possible to reciprocate rapidly the relative rotation phase (the vane 5) between the rotor 1 and the housing 20. Thus, the relative rotation phase (the vane 5) reaches rapidly the intermediate phase by the cam fluctuation torque. Thus, an advantageous point of locking easily can be obtained. Further, when the engine halt signal is output, since the lock oil passage 66 is drained and oil is efficiently discharged, it is possible to actuate rapidly the lock portions 6 and 6B.

As obviously explained in the above, according to the present aspect, since the engine can be stopped based on the engine halt signal, even if the engine oil pressure becomes low, the relative rotation phase between the rotor 1 and the housing 20 can be locked at the intermediate phase excellently. Thus, an excellent condition of starting the engine can be obtained.

Here, according to the present aspect, if the engine is not stopped by operating the IG key switch 90*k* by the vehicle's driver but stopped by an engine stall, the relative rotation phase may not be locked at the intermediate phase. In this case, when the engine is started again, at the time of causing the relative rotation phase between the rotor 1 and the housing 20 due to the cam fluctuation torque, the relative rotation phase moves to the intermediate phase and then locked. Thus, an excellent condition of starting the engine can be obtained.

(Second embodiment)

Figure 20A:
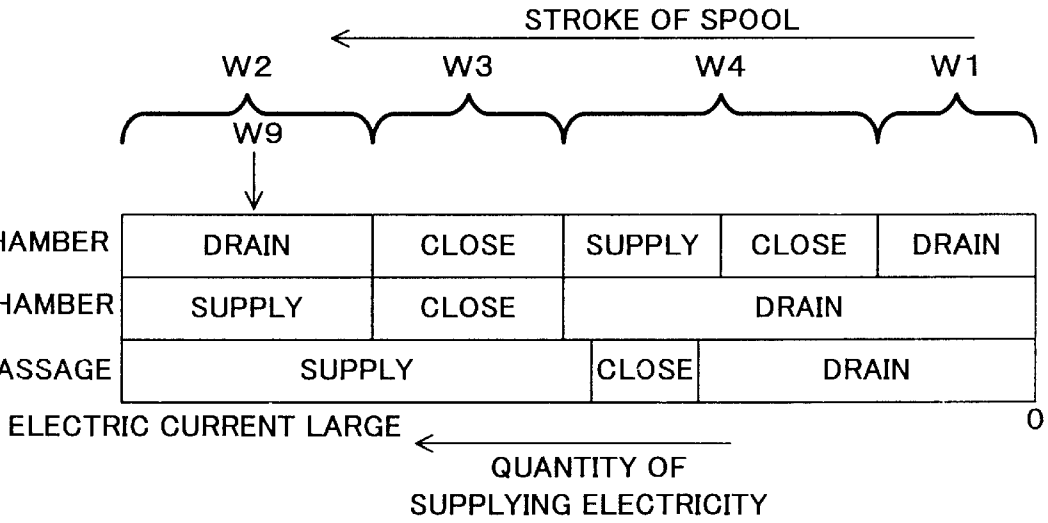
FIGS. 20A and 20B are process drawings of the relationship between actuation and the stroke of the spool of the hydraulic control valve.
Figure 20B:
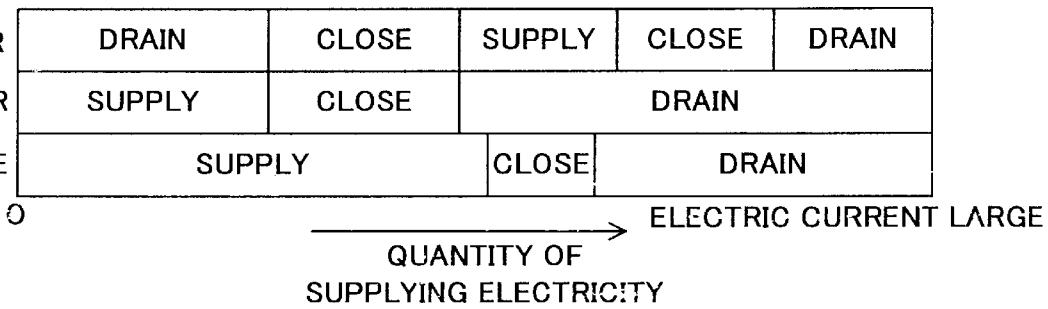

Basically, the second embodiment has the same structure of the first embodiment. The second embodiment can utilize FIGS. 1 to 5. Basically, the second embodiment can cause the same effects and function as the first embodiment. FIG. 20A indicates the condition of actuating the hydraulic control valve 76 of the hydraulic circuit 7 of the second embodiment. As shown in FIG. 20A, the horizontal axis indicates the quantity of supplying electricity to the solenoid 87 of the hydraulic control valve 76, that is to say, the stroke of the spool 85. When the quantity of supplying electricity is zero, each of the advance angle chamber 43, the retard angle chamber 42, and the lock oil passage 66 is set as drain. Thus, the main drain operation for performing three drain operations of the advance angle chamber 43, the retard angle chamber 42, and the lock oil passage 66 can be performed. For the retard angle chamber 42 of FIGS. 20A and 20B, as the quantity of supplying electricity to the solenoid 87 of the hydraulic control valve 76 increases and the spool 85 moves, the retard angle chamber 42 is set as drain, close, oil supply, close, and drain respectively. For the advance angle chamber 43, as the quantity of supplying electricity to the solenoid 87 of the hydraulic control valve 76 increases, the advance angle chamber 43 is set as drain, close, and oil supply respectively. For the lock oil passage 66, as the quantity of supplying electricity to the solenoid 87 of the hydraulic control valve 76 increases, the lock oil passage 66 is set as drain, close, and oil supply respectively. In other words, the hydraulic control valve 76 can adopt an aspect having the hydraulic control valve 76 for performing the main drain operation as the spool 85 moves.

That is to say, the hydraulic control valve 76 of FIG. 20A includes the retard angle control position W4 for moving the relative rotation phase towards the retard angle, the intermediate phase holding control position W3 for holding the relative rotation phase at the intermediate phase, the advance angle control position W2 for moving the relative rotation phase towards the advance angle, and the main drain control position W1 for performing the main drain operation. These positions W1 to W4 are switched as the spool 85 moves.

As obviously seen in FIG. 20A, if the relative rotation phase (the vane 5) is at an advance angle phase W9, the engine halt signal is output. If the quantity of supplying electricity to the solenoid 87 is zero, the main drain control position W1 is reached after the retard angle control position W4 is passed. In this way, when the spool 85 moves towards the main drain control position W1 in order to perform the main drain operation based on the engine halt signal, if the retard angle control position W4 is passed on the way, a noise for moving the relative rotation phase (the vane 5) in the retard angle direction is caused. Thus, when the relative rotation phase is moved to the intermediate phase based on the engine halt signal and locked, ECU 9 sets the target value of the relative rotation phase as "the intermediate phase +α." The meaning of "+α" is a setting value for moving the relative rotation phase (the vane 5) in the advance angle direction. Accordingly, a noise towards the advance angle and "+α" are cancelled or actually offset, and thus influence caused by the above mentioned noise is suppressed. Consequently, before reducing the oil pressure of the engine, relative rotation phase (the vane 5) can reach rapidly the intermediate phase as the lock position. Thus, it is possible to perform rapidly the operation of moving the lock portions 6 and 6B in the locking direction. Here, the actuating condition of FIG. 20B may also be utilized therefor.

(Third embodiment)

The above mentioned hydraulic control valve 76 is a both drain type of draining both of the retard angle chamber 42 and the advance angle chamber 43 at the time of draining the lock oil passage 66. However, the drain type is not limited to both drain type hydraulic control valve 76, but a single drain type may be possible, which can drain any one of the retard angle chamber 42 and the advance angle chamber 43 at the time of draining the lock oil passage 66, as indicated in the third embodiment.

Figure 21:
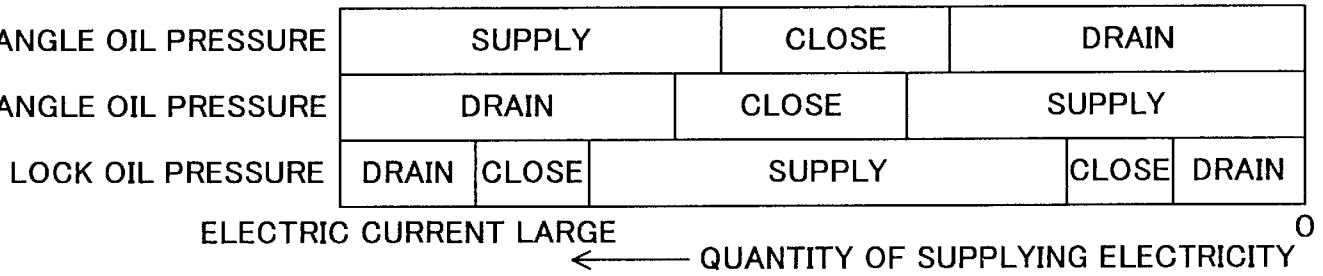
FIG. 21 is a process drawing for explaining a hydraulic control valve of another portion.

Basically, the third embodiment has the same structure of the first embodiment. The third embodiment can utilize FIGS. 1 to 5. Basically, the third embodiment can cause the same effects and function as the first embodiment. FIG. 21 indicates the condition of actuating the hydraulic control valve 76D of the hydraulic circuit 7 of the first aspect of the third embodiment. The hydraulic control valve 76D is a single drain type of draining one of the retard angle chamber 42 and the advance angle chamber 43 at the time of draining the lock oil passage 66. As shown in FIG. 21, the horizontal axis indicates the quantity of supplying electricity to the solenoid 87 of the hydraulic control valve 76D, that is to say, the stroke of the spool 85. When the quantity of supplying electricity is zero, each of the advance angle oil pressure of the advance angle chamber 43, the retard angle oil pressure of the retard angle chamber 42, and the lock oil pressure of the lock oil passage 66 is set as drain, supply, and drain respectively. Thus, the main drain operation can be performed. For the advance angle chamber 43, as the quantity of supplying electricity to the solenoid 87 of the hydraulic control valve 76D increases and the spool 85 moves, the advance angle chamber 43 is set as drain, close, and oil supply respectively. For the retard angle chamber 42, as the quantity of supplying electricity to the solenoid 87 of the hydraulic control valve 76D increases, the retard angle chamber 42 is set as oil supply, close, and drain respectively. For the lock oil passage 66, as the quantity of supplying electricity to the solenoid 87 of the hydraulic control valve 76D increases, the lock oil passage 66 is set as drain, close, oil supply, close, and drain respectively.

Figure 22:
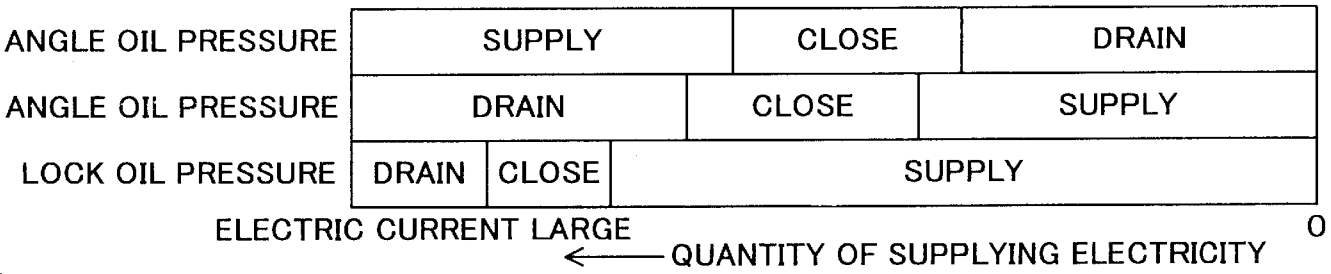
FIG. 22 is a process drawing for explaining a hydraulic control valve of another different portion.

FIG. 22 indicates the condition of actuating the hydraulic control valve 76E of the hydraulic circuit 7 of the second aspect of the third embodiment. The hydraulic control valve 76E is a single drain type of draining the retard angle chamber 42 at the time of draining the lock oil passage 66. As shown in FIG. 21, the horizontal axis indicates the quantity of supplying electricity to the solenoid 87 of the hydraulic control valve 76E, that is to say, the stroke of the spool 85. When the quantity of supplying electricity is zero, each of the advance angle oil pressure of the advance angle chamber 43, the retard angle oil pressure of the retard angle chamber 42, and the lock oil pressure of the lock oil passage 66 is set as drain, supply, and supply respectively. For the advance angle chamber 43, as the quantity of supplying electricity to the solenoid 87 of the hydraulic control valve 76E increases and the spool 85 moves, the advance angle chamber 43 is set as drain, close, and oil supply respectively. For the retard angle chamber 42, as the quantity of supplying electricity to the solenoid 87 of the hydraulic control valve 76E increases, the retard angle chamber 42 is set as oil supply, close, and drain respectively. For the lock oil passage 66, as the quantity of supplying electricity to the solenoid 87 of the hydraulic control valve 76E increases, the lock oil passage 66 is set as oil supply, close, and drain respectively.

Figure 23:
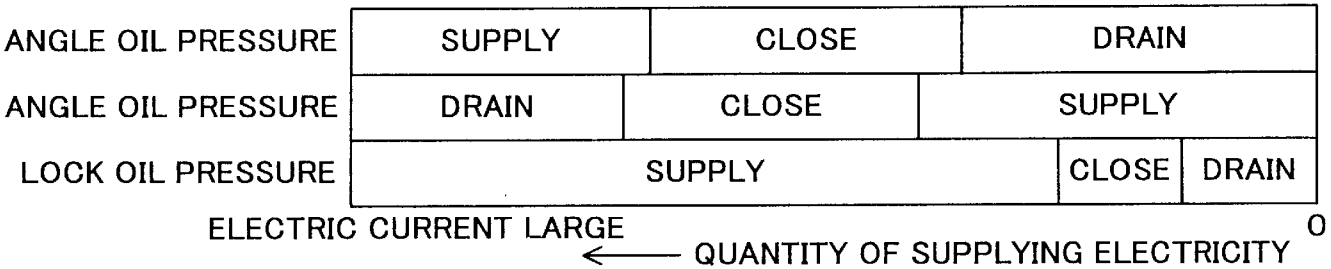
FIG. 23 is a process drawing for explaining a hydraulic control valve of another different portion.

FIG. 23 indicates the condition of actuating the hydraulic control valve 76F of the hydraulic circuit 7 of the third aspect of the third embodiment. The hydraulic control valve 76F is a single drain type of draining the advance angle chamber 43 at the time of draining the lock oil passage 66. As shown in FIG. 21, the horizontal axis indicates the quantity of supplying electricity to the solenoid 87 of the hydraulic control valve 76F, that is to say, the stroke of the spool 85. When the quantity of supplying electricity is zero, each of the advance angle oil pressure of the advance angle chamber 43, the retard angle oil pressure of the retard angle chamber 42, and the lock oil pressure of the lock oil passage 66 is set as drain, supply, and drain respectively. For the advance angle chamber 43, as the quantity of supplying electricity to the solenoid 87 of the hydraulic control valve 76F increases and the spool 85 moves, the advance angle chamber 43 is set as drain, close, and oil supply respectively. For the retard angle chamber 42, as the quantity of supplying electricity to the solenoid 87 of the hydraulic control valve 76F increases, the retard angle chamber 42 is set as oil supply, close, and drain respectively. For the lock oil passage 66, as the quantity of supplying electricity to the solenoid 87 of the hydraulic control valve 76F increases, the lock oil passage 66 is set as drain, close, and oil supply respectively.

Figure 24:
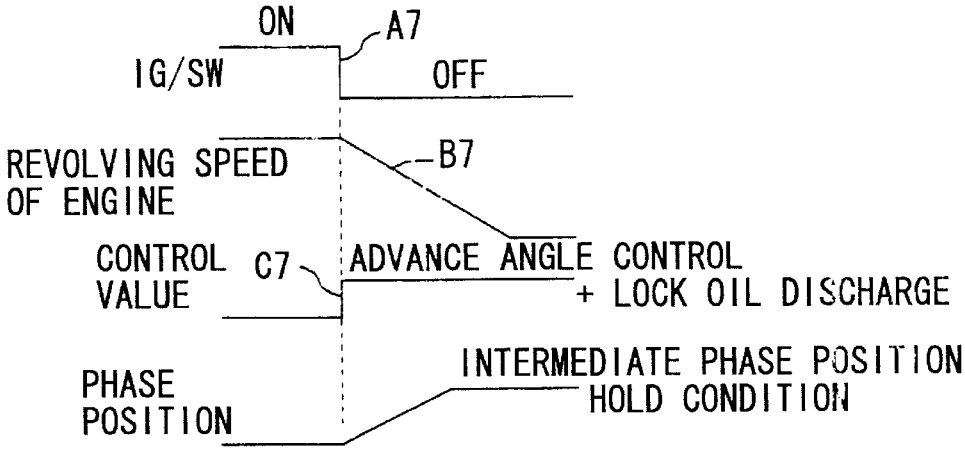
FIG. 24 is a timing chart of another control aspect.

FIG. 24 is a timing chart in the case that the hydraulic control valve 76D is utilized. FIG. 24 is a timing chart of a control aspect in which the relative rotation phase (the vane 5) is in the side of the retard angle and the engine is stopped at the time of idling. As indicated in FIG. 24, if the IG key switch 90*k* is operated by the vehicle's driver at the time of the idling condition, an engine halt signal A7 is input to ECU 9. Then, the revolving speed of the engine decreases gradually as indicated in a property line B7 and the oil pressure of the engine decreases gradually as well. In such a case, ECU 9 outputs a control signal C7 containing the control value of the spool 85 to the solenoid 87 of the hydraulic control valve 76. The control signal C7 is a signal for performing an advance angle control operation for moving the relative rotation phase (the vane 5) in the side of the retard angle towards the advance angle and for draining the lock oil passage 66. The control signal C7 is also a signal for increasing an electric current of the hydraulic control valve 76 of FIG. 21.

Figure 25:
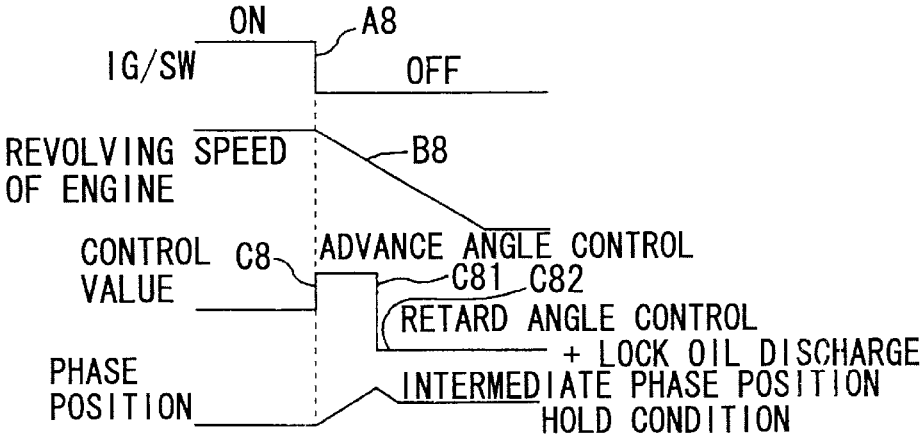
FIG. 25 is a timing chart of still another control aspect.

FIG. 25 is a timing chart in the case that the hydraulic control valve 76D is utilized. FIG. 25 is a timing chart of a control aspect in which the relative rotation phase (the vane 5) is in the vicinity of the intermediate phase and the engine is stopped at the time of not idling. As indicated in FIG. 25, if the IG key switch 90*k* is operated by the vehicle's driver at the time of the idling condition, an engine halt signal A8 is input to ECU 9. Then, the revolving speed of the engine decreases gradually as indicated in a property line B8 and the oil pressure of the engine decreases gradually as well. In such a case, ECU 9 outputs a control signal C8 containing the control value of the spool 85 to the solenoid 87 of the hydraulic control valve 76. The control signal C8 includes a signal C81 for performing an advance angle control operation (oil is supplied to the advance angle chamber 43 and the retard angle chamber 42 is drained) for moving the relative rotation phase (the vane 5) towards the advance angle and a signal C82 for controlling thereafter the retard angle (the advance angle chamber 43 is drained and oil is supplied to the retard angle chamber 42) and for draining the lock oil passage 66.

Here, according to the above mentioned valve opening-closing timing control device, the relative rotation phase (the vane 5) is within a prescribed distance for the intermediate phase. If the relative rotation phase (the vane 5) is close thereto considerably, before oil of the lock oil passage 66 is discharged and a locked condition is made, the vane 5 may pass the intermediate phase as the lock position. Thus, the relative rotation phase (the vane 5) is moved in the retard direction and then once released from the intermediate phase. Then, the first control operation can be performed for moving in the advance angle direction as the reverse direction. Otherwise, as indicated in FIG. 25, the relative rotation phase (the vane 5) is moved in the advance angle direction and the relative rotation phase (the vane 5) is once released from the intermediate phase. Then, the second control operation can be performed for moving the relative rotation phase (the vane 5) in the retard angle direction as the reverse direction. In this way, while the relative rotation phase (the vane 5) is once released from the intermediate phase as the lock position, time for discharging oil from the lock oil passage 66 can be kept and lock oil can be discharged effectively. Thus, the lock portions 6 and 6B can be actuated rapidly.

Further, as indicated in the above, in the case that the relative rotation phase (the vane 5) is once moved in the advance angle direction, once released from the intermediate phase, and thereafter moved in the retard angle direction, it is preferable to move the vane 5 in the retard angle direction securely. However, since the engine has stopped, the oil pressure decreases gradually. Thus, it is possible to set the actuating power of the vane actuating spring 27 for activating the vane 5 in the advance angle direction all the time so as to be lower than the average value of the cam fluctuation torque. Therefore, even if the oil pressure is decreased, an advantageous point for moving the relative rotation phase (the vane 5) in the retard direction can be obtained.

In the first to third embodiments, the value of the cam fluctuation torque is influenced by the viscosity of oil. Here, the average value of the cam fluctuation torque is defined as FT, if oil having the biggest viscosity is selected from various kinds of usable oil. The vane actuating spring 27 having the actuating power bigger than FT can be used. Accordingly, the vane 5 can be activated in the advance angle direction rapidly and thus the vane actuating spring 27 can perform the original function. In this case, although the vane 5 can be activated in the advance angle direction, it is preferable to cancel the noise caused thereby. Thus, when the engine halt signal is output and the relative rotation phase is moved to the intermediate phase, ECU 9 sets the target value of the relative rotation phase as "the intermediate phase $-\alpha 3$." The meaning of "$-\alpha 3$" is a setting value of the phase of the relative rotation phase (the vane 5) moving in the retard angle direction. Accordingly, "$-\alpha 3$" and a noise caused by the vane actuating spring 27 in the advance angle direction are cancelled or actually offset. Consequently, the relative rotation phase (the vane 5) can reach rapidly the intermediate phase as the lock position, and the locking operation of the lock portions 6 and 6B can be performed rapidly.

Each of the above mentioned embodiments uses the hydraulic control valve 76 as a single element. However, plural hydraulic control valves can be used therefor. For example, it is possible to utilize the first hydraulic control valve for supplying or discharging oil to or from the retard angle path 71 and the second hydraulic control valve for supplying or discharging oil to or from the advance angle path 72. Otherwise, the present invention is not limited to the above mentioned embodiments, but the present invention can be modified suitably within the scope of the subject matter. For example, the vane 5 can be formed in the housing 20.

The following technical idea can be obtained from the above mentioned description.

The valve opening-closing timing control device having the first rotary member for rotating integrally with one of the cam shaft and the crank shaft of the engine; the second rotary member, which is engaged with the above mentioned first rotary member so as to form a fluid pressure chamber between the above mentioned first rotary member and the above mentioned second rotary member, for rotating integrally with another member of the cam shaft and the crank shaft of the engine; a vane, which is provided in the above mentioned first rotary member and/or the above mentioned second rotary member, for separating the above mentioned fluid pressure chamber into the retard angle chamber and the advance angle chamber; and the relative rotation control mechanism having the first path for moving the relative rotation phase between the first rotary member and the second rotary member in the range of the most retarded angle phase and the most advanced angle phase by supplying or discharging oil to or from the advance angle chamber and/or the retard angle chamber; a lock portion for locking the relative rotation phase between the first rotary member and the second rotary member in the intermediate phase between the most retarded angle phase and the most advanced angle phase; and a lock oil passage for actuating the lock portion, includes a control means for discharging oil from one or both of the retard angle chamber and the advance angle chamber based on the engine halt signal and performing the drain operation for discharging oil from the lock oil passage, and outputting a command for locking the relative rotation phase at the intermediate phase in accordance with the operation.

In this case, at the time of stopping the engine, since the main drain operation is performed for discharging oil from one or both of the retard angle chamber and the advance angle chamber and for discharging oil from the lock oil passage, the relative rotation phase (i.e., the reciprocal movement of the vane) between the first rotary member and the second rotary member can be moved rapidly, the relative rotation phase (the vane) can reach the intermediate phase rapidly and then the relative rotation phase can be locked.

In accordance with the valve opening-closing timing control device of the present invention, since the second path connected to the lock oil passage is separated from the first path, an advantageous point for suppressing influence of oil pressure fluctuation of the advance angle chamber and the retard angle chamber caused by the cam fluctuation torque can be obtained at the time of actuating the lock portion.

In accordance with the valve opening-closing timing control device, based on the engine halt signal, the hydraulic circuit performs the main drain operation for discharging oil from one or both of the retard angle chamber and the advance angle chamber and for discharging oil from the lock oil passage and locks the relative rotation phase at the intermediate phase in accordance with the operation. Therefore, if the engine is stopped based on the engine halt signal, since oil can be discharged efficiently from one or both of the retard angle chamber and the advance angle chamber, one or both of the retard angle chamber and the advance angle chamber becomes rapidly empty or nearly empty. Even If the oil pressure decreases, the relative rotation phase (i.e., the reciprocal movement of the vane) between the first rotary member and the second rotary member can be moved rapidly, and thus the locking operation can be performed easily because the relative rotation phase (the vane) reaches the intermediate phase.

Since the second path connected to the lock, oil passage is provided separately, the efficiency of discharging oil from the lock oil passage can be improved and the lock portion can be actuated rapidly. Therefore, the engine is stopped based on the engine halt signal, even if the engine oil pressure decreases, the relative rotation phase can be locked at the intermediate phase excellently. Thus, the efficiency of starting thee engine can be improved.

What is claimed is:

1. A valve timing control device for controlling valve opening-closing timing of an engine, comprising:

a first rotary member for rotating integrally with one of a cam shaft and a crank shaft of an engine;

a second rotary member being engaged with said first rotary member so as to form a fluid pressure chamber between said first rotary member and said second rotary member and rotating integrally with the other member of said cam shaft and said crank shaft of said engine;

a vane being provided in said first rotary member or said second rotary member and separating said fluid pressure chamber into a retard angle chamber and an advance angle chamber;

a relative rotation control mechanism having a first path for controlling a relative rotation phase between said first rotary member and said second rotary member in a range between a most retarded angle phase and a most advanced angle phase by supplying or discharging oil to or from said advance angle chamber and/or said retard angle chamber, a lock portion for locking the relative rotation phase between said first rotary member and said second rotary member at an intermediate phase between the most retarded angle phase and the most advanced angle phase;

a lock oil passage for actuating said lock portion, a second path, which is provided separately from said first path and connected to said lock oil passage, for supplying or discharging said oil to or from said lock oil passage; and a control means for discharging said oil from one or both of said retard angle chamber and said advance angle chamber based on an engine halt signal and performing a main drain operation for discharging said oil from said lock oil passage through said second path.

2. The valve timing control device according to claim 1, wherein said relative rotation control mechanism further includes a hydraulic circuit having a hydraulic control valve for performing said main drain operation as a spool moves.

3. The valve timing control device according to claim 2, wherein:

said hydraulic control valve includes an intermediate phase holding control position for holding said relative rotation phase at an intermediate phase, an advance angle control position for controlling said relative rotation phase in an advance angle direction, and a main drain control position for performing said main drain operation and is formed of a structure capable of switching said intermediate phase holding control position, said advance angle control position, and said main drain control position, as said spool moves, and said spool passes said advance angle control position at a time of moving towards said main drain control position so as to perform said main drain operation based on said engine halt signal.

4. The valve timing control device according to claim 3, wherein:

said control means sets a target value of said relative rotary position as "the intermediate phase $-\alpha$" at a time of operating said main drain operation based on said engine halt signal by defining "$-\alpha$" as a setting value of the relative rotation phase moving in a retard angle direction.

5. The valve timing control device according to claim 2, wherein:

said hydraulic control valve has an intermediate phase hold position for holding said relative rotation phase at an intermediate phase, a retard angle control position for moving said relative rotation phase in a retard angle direction, and a main drain control position for performing said main drain operation and is formed of a structure capable of switching said intermediate phase hold position, said retard angle control position, and said drain control position as said spool moves and said spool passes said advance angle control position at a time of moving towards said drain control position so as to perform said drain operation based on said engine halt signal.

6. The valve timing control device according to claim 5, wherein:

said control means sets a target value of said relative rotary position as "an intermediate phase $+\alpha$" at a time of operating said main drain operation based on said engine halt signal by defining "$+\alpha$" as a setting value so as to move said relative rotation phase in an advance angle direction.

7. The valve timing control device according to claim 1, wherein:

said control means outputs, at a time of an advance angle control position for controlling said relative rotation phase in an advance angle direction and a retard angle control position for moving said relative rotation phase in a retard angle direction, a command for moving said relative rotation phase in an advance angle direction and discharging said oil of said lock oil passage.

8. The valve timing control device according to claim 1, wherein:

said control means outputs a command for performing a drain capacity control for improving a capacity of discharging said oil of said lock oil passage up to a time of finishing said main drain operation from a time of generating said engine halt signal.

9. The valve timing control device according to claim 2, wherein:

said hydraulic control valve has an intermediate phase hold position for holding said relative rotation phase at an intermediate phase, a retard angle control position for moving said relative rotation phase in a retard angle direction, and a main drain control position for performing said main drain operation and is formed of a structure capable of switching said intermediate phase hold position, said retard angle control position, and said drain control position as said spool moves and said spool passes an advance angle control position for controlling said relative rotation phase in an advance angle direction at a time of moving towards said drain control position so as to perform said drain operation based on said engine halt signal, wherein, said control means outputs, at a time of said advance angle control position and said retard angle control position, a command for moving said relative rotation phase in an advance angle direction and discharging said oil of said lock oil passage and for performing a drain capacity control for improving a capacity of discharging said oil of said lock oil passage up to a time of finishing said main drain operation from a time of generating said engine halt signal.

10. The valve timing control device according to claim 2 wherein:

said control means outputs, at a time of an advance angle control position for controlling said relative rotation phase in an advance angle direction and a retard angle control position for moving said relative rotation phase in a retard angle direction, a command for moving said relative rotation phase in an advance angle direction and discharging said oil of said lock oil passage.

11. The valve timing control device according to claim 3, wherein:

said control means outputs, at a time of said advance angle control position and a retard angle control position for moving said relative rotation phase in a retard angle direction, a command for moving said relative rotation phase in an advance angle direction and discharging said oil of said lock oil passage.

12. The valve timing control device according to claim 4, wherein:

said control means outputs, at a time of said advance angle control position and a retard angle control position for moving said relative rotation phase in a retard angle direction, a command for moving said relative rotation phase in an advance angle direction and discharging said oil of said lock oil passage.

13. The valve timing control device according to claim 5, wherein:

said control means outputs, at a time of an advance angle control position for controlling said relative rotation phase in an advance angle direction and said retard angle control position, a command for moving said relative rotation phase in an advance angle direction and discharging said oil of said lock oil passage.

14. The valve timing control device according to claim 6, wherein:

said control means outputs, at a time of an advance angle control position for controlling said relative rotation phase in an advance angle direction and said retard angle control position, a command for moving said relative rotation phase in an advance angle direction and discharging said oil of said lock oil passage.

15. The valve timing control device according to claim 2, wherein:

said control means outputs a command for performing a drain capacity control for improving a capacity of discharging said oil of said lock oil passage up to a time of finishing said main drain operation from a time of generating said engine halt signal.

16. The valve timing control device according to claim 3, wherein:

said control means outputs a command for performing a drain capacity control for improving a capacity of discharging said oil of said lock oil passage up to a time of finishing said main drain operation from a time of generating said engine halt signal.

17. The valve timing control device according to claim 4, wherein:

said control means outputs a command for performing a drain capacity control for improving a capacity of discharging said oil of said lock oil passage up to a time of finishing said main drain operation from a time of generating said engine halt signal.

18. The valve timing control device according to claim 5, wherein:

said control means outputs a command for performing a drain capacity control for improving a capacity of discharging said oil of said lock oil passage up to a time of finishing said main drain operation from a time of generating said engine halt signal.

19. The valve timing control device according to claim 6, wherein:

said control means outputs a command for performing a drain capacity control for improving a capacity of discharging said oil of said lock oil passage up to a time of finishing said main drain operation from a time of generating said engine halt signal.

20. The valve timing control device according to claim 7, wherein:

said control means outputs a command for performing a drain capacity control for improving a capacity of discharging said oil of said lock oil passage up to a time of finishing said main drain operation from a time of generating said engine halt signal.

21. A valve timing control device for controlling valve opening-closing timing of an engine, comprising:

a first rotary member for rotating integrally with one of a cam shaft and a crank shaft of an engine;

a second rotary member being engaged with said first rotary member so as to form a fluid pressure chamber between said first rotary member and said second rotary member and rotating integrally with the other member of said cam shaft and said crank shaft of said engine;

a vane being provided in said first rotary member or said second rotary member and separating said fluid pressure chamber into a retard angle chamber and an advance angle chamber;

a relative rotation control mechanism having a first path for controlling a relative rotation phase between said first rotary member and said second rotary member in a range between a most retarded angle phase and a most advanced angle phase by supplying or discharging oil to or from said advance angle chamber and/or said retard angle chamber, a lock portion for locking the relative rotation phase between said first rotary member and said second rotary member at an intermediate phase between the most retarded angle phase and the most advanced angle phase;

a lock oil passage for actuating said lock portion, a second path, which is provided separately from said first path and connected to said lock oil passage, for supplying or discharging said oil to or from said lock oil passage;

a control means for discharging said oil from one or both of said retard angle chamber and said advance angle chamber based on an engine halt signal and performing a main drain operation for discharging said oil from said lock oil passage through said second path; and an electronic control unit for supplying an electric current through to a solenoid of a hydraulic control valve.

22. The valve timing control device according to claim 21, wherein:

said electronic control unit has built-in memories for storing computer executable programs, CPU, an input interface circuit, and an output interface circuit.

23. The valve timing control device according to claim 21, wherein said electronic control unit has sensors including:

a cam angle sensor for detecting a cam angle of a crank shaft;

a crank angle sensor for detecting a phase of said crank shaft;

a water temperature sensor for detecting temperature of cooling water for an engine; and an oil temperature sensor for detecting temperature of said oil for said engine.

24. The valve timing control device according to claim 23, wherein said sensors further include:

a vehicle speed sensor for detecting a speed of a vehicle;

a revolving speed sensor for detecting speed of said engine;

a throttle angle sensor for detecting an opening of a throttle valve; and an ignition key switch for controlling a start/stop operation of said engine.

25. The valve timing control device according to claim 23, wherein:

said cam angle sensor outputs a control value of an actual relative rotation phase between a rotor and a housing;

said crank angle sensor outputs a control value of a crank angle; and said cam angle sensor and said crank angle sensor can function as a VVT (Variable Valve Timing) sensor for detecting said actual relative rotation phase.

26. The valve timing control device according to claim 21, wherein:

said electronic control unit outputs a control signal containing a controlling value to said solenoid of said hydraulic control valve for draining both of a retard angle chamber and an advance angle chamber and for performing a main drain operation for draining a lock oil passage.

27. The valve timing control device according to claim 21, wherein said hydraulic circuit includes:

an oil pump for supplying said oil;

an oil pan for gathering said oil exhausted by way of an exhaust passage;

a hydraulic control valve for changing a volume of stroking of a spool by a quantity of supplying electricity to said solenoid;

a first path for supplying said oil to and discharging said oil from an advance angle path or a retard angle path; and a second path connected to a lock oil passage for supplying said oil to and discharging said oil from said lock oil passage.

28. The valve timing control device according to claim 27, wherein:

said second path has an orifice between said hydraulic control valve and said oil pump.

29. A valve timing control device for controlling valve opening-closing timing of an engine, comprising:

a first path for supplying and discharging oil for moving a relative rotation phase between a first rotary member and a second rotary member;

a second path for supplying or discharging said oil to or from a lock oil passage;

an electronic control unit for supplying an electric current through a lead line to a solenoid of a hydraulic control valve; and a control means for discharging said oil from one or both of a retard angle chamber and an advance angle chamber through said first path based on an engine halt signal and performing a drain operation for discharging said oil from said lock oil passage through said second path.

30. The valve timing control device according to claim 29, wherein:

said electronic control unit outputs a control signal, wherein said advance angle chamber is set as drain, close, and oil supply respectively and said retard angle chamber is set as oil supply, close, and drain respectively.

31. The valve timing control device according to claim 29, wherein:

said electronic control unit outputs a control signal indicating a control value of a spool to said solenoid for draining said advance angle chamber, said retard angle chamber, and said lock oil passage.

* * * * *